US012507746B2

(12) United States Patent
Lynn et al.

(10) Patent No.: US 12,507,746 B2
(45) Date of Patent: Dec. 30, 2025

(54) SWIMSUIT WITH INSERTS

(71) Applicant: SABAL LLC, Las Vegas, NV (US)

(72) Inventors: Hartley Lynn, La Jolla, CA (US); Preston Lynn, La Jolla, CA (US)

(73) Assignee: SABAL LLC, Las Vegas, NV (US)

( * ) Notice: Subject to any disclaimer, the term of this patent is extended or adjusted under 35 U.S.C. 154(b) by 0 days.

(21) Appl. No.: 18/862,210

(22) PCT Filed: May 9, 2023

(86) PCT No.: PCT/US2023/021445
§ 371 (c)(1),
(2) Date: Nov. 1, 2024

(87) PCT Pub. No.: WO2023/219995
PCT Pub. Date: Nov. 16, 2023

(65) Prior Publication Data

US 2025/0288027 A1 Sep. 18, 2025

Related U.S. Application Data

(60) Provisional application No. 63/339,629, filed on May 9, 2022.

(51) Int. Cl.
*A41D 7/00* (2006.01)
*A41C 3/10* (2006.01)

(52) U.S. Cl.
CPC . *A41D 7/00* (2013.01); *A41C 3/10* (2013.01)

(58) Field of Classification Search
CPC ..... A41D 7/00; A41C 3/10
USPC ..... 2/67; 450/54–57, 36
See application file for complete search history.

(56) References Cited

U.S. PATENT DOCUMENTS

| | | | | |
|---|---|---|---|---|
| 2,834,352 | A * | 5/1958 | Murry | A41C 3/144 450/57 |
| 3,161,200 | A | 12/1964 | Brickman | |
| 4,414,691 | A * | 11/1983 | Estruch | A41D 15/005 2/400 |
| 4,571,742 | A | 2/1986 | Wior | |
| 6,110,006 | A * | 8/2000 | Chen | A41C 3/144 623/7 |
| 2010/0180358 | A1* | 7/2010 | Drummond | A41D 7/00 2/244 |
| 2011/0217903 | A1* | 9/2011 | Harlow | A41C 3/12 450/55 |
| 2014/0182042 | A1* | 7/2014 | Marchand | A41D 7/00 2/67 |
| 2015/0007374 | A1* | 1/2015 | Larson | A41D 15/00 2/67 |
| 2015/0087204 | A1 | 3/2015 | Conde | |

OTHER PUBLICATIONS

International Search Report and Written Opinion for International Patent Application No. PCT/US23/21445, mailed Jul. 27, 2023, 16 pages.

* cited by examiner

*Primary Examiner* — Gloria M Hale
(74) *Attorney, Agent, or Firm* — HAYNES AND BOONE, LLP

(57) ABSTRACT

Swimsuits for small-chested wearers and the designs therefor according to which the designs include inserts. The inserts are non-removable. The non-removable inserts contour to the shape of the human body, specifically the breast.

21 Claims, 17 Drawing Sheets

SWIMSUIT WITH INSERTS

CROSS-REFERENCE TO RELATED APPLICATIONS APPLICATION

This application is a United States national phase application of co-pending international patent application number PCT/US2023/021445, filed May 9, 2023, which claims the benefit of the filing date of, and priority to, U.S. Application No. 63/339,629, filed May 9, 2022, the entire disclosures of which are hereby incorporated herein by reference.

BACKGROUND

This application relates generally to swimsuits and inserts and, more particularly, to non-removable inserts for swimsuits designed for small-chested wearers.

BRIEF DESCRIPTION OF THE DRAWINGS

Aspects of the present disclosure are best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion. In addition, the present disclosure may repeat reference numerals, letters, or both in the various examples. This repetition is for the purpose of simplicity and clarity and does not in itself dictate a relationship between the various embodiments and/or configurations discussed.

DETAILED DESCRIPTION

Figure 1:
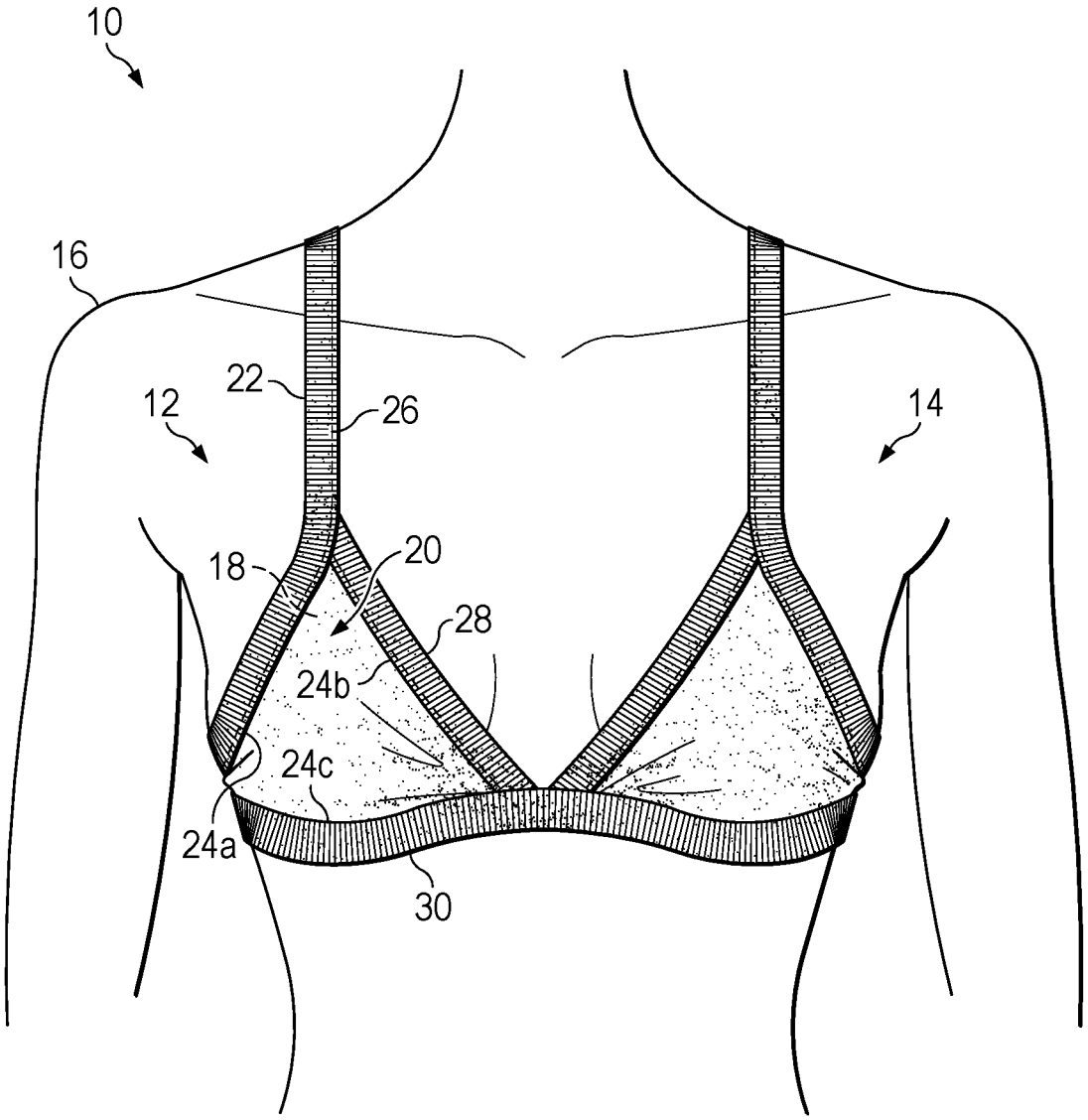
FIG. 1 is a diagrammatic illustration of a front view of a swimsuit that includes two inserts, according to one or more embodiments.

It is to be understood that the present disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity and does not in itself dictate a relationship between the various embodiments and/or configurations discussed.

In one or more embodiments, the methods and apparatuses herein provide a non-removable insert that stays in place in a swimsuit and a swimsuit that stays in place on the wearer. The swimsuit has stitching around the non-removable insert keeping the non-removable insert in place. Therefore, the non-removable insert does not move when the swimsuit is washed or worn. The swimsuit is designed to stay in place (in particular, on the breasts) in activities: such as, but not limited to, swimming and sun-bathing. The swimsuit stays in place on the wearer of the swimsuit because the non-removable insert contours to the breast of the wearer.

In some embodiments, the methods and apparatuses herein provide a non-removable insert that provides a gentle lift and supplements the breast of a small-chested wearer without making the wearer appear to be multiple cup sizes larger. Instead, at least a portion of the non-removable insert acts on the breast by lifting the breast, but also keeps the breast held in place so that the breast does not move away from the non-removable insert. The non-removable insert further provides supplement to the breast. The non-removable insert contours to the breast such that the supplementation appears natural. Additionally, the non-removable insert, due to its ability to contour to the breast, is designed for small-chested wearers such that a hole, an opening, or a gap is not present between the swimsuit and the wearer, which occurs when a swimsuit does not fit properly, especially when a swimsuit is designed for large-chested wearers, rather than small-chested.

Referring to FIG. 1, in an embodiment, a swimsuit for small chested wearers is generally referred to by reference numeral 10 and includes a first side 12 and a second side 14. The first side 12 is defined by being located substantially on the proper right side of a wearer 16 and includes a non-removable insert 18 (not visible), a front panel 20, and one or more straps 22. The non-removable insert 18 is disposed behind the front panel 20. The front panel 20 is bound by a first edge 24*a*, a second edge 24*b*, and a third edge 24*c*. One of the one or more straps 22 extends in part along the first edge 24*a*. The one of the one or more straps 22 is coupled to the front panel 20 via stitching. The seam 26 couples the one of the one or more straps 22 to the front panel 20. A strip of fabric 28 extends along the second edge 24*b*. The strip of fabric 28 is coupled to at least the one of the one or more straps 22 and the front panel 20 via stitching. A band 30 extends along at least the third edge 24*c*. The band 30 is coupled to at least the one of the one or more straps 22 and the strip of fabric 28 via stitching. The second side 14 mirrors the first side 12 and includes similar components as described herein for the first side 12. The band 30 is the same for the first side 12 as for the second side 14, as the band 30 extends at least along a front width of a torso of the wearer 16.

Figure 2:
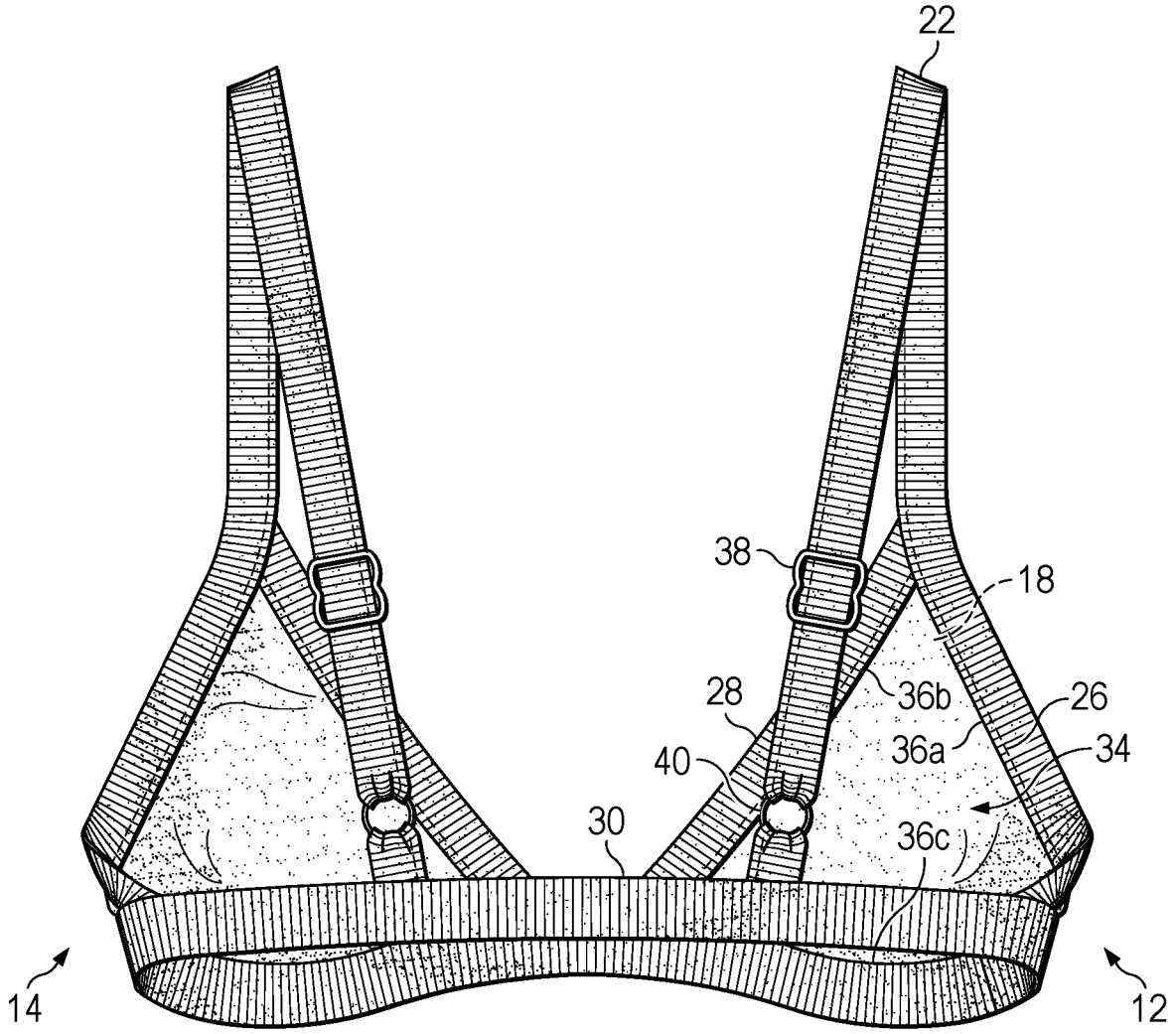
FIG. 2 is a diagrammatic illustration of a back view of the swimsuit of FIG. 1, according to one or more embodiments.

Referring to FIG. 2, in an embodiment, with continuous reference to FIG. 1, a back view of the swimsuit 10 for small chested wearers is generally referred to by reference numeral 32 and includes the first side 12 and the second side 14. The proper right side of the swimsuit 10 includes the first side 12. The first side 12 includes the non-removable insert 18 (indentations from the non-removable insert 18 may be visible but otherwise, the non-removable insert 18 is not shown), a back panel 34, and the one or more straps 22. The non-removable insert 18 is disposed behind the back panel 34. The back panel 34 is bound by a first edge 36*a*, a second edge 36*b*, and a third edge 36*c* (positioned behind the band 30). The one of the one or more straps 22 extends in part along the first edge 36*a*. The one of the one or more straps 22 is coupled to the back panel 34 via stitching. The seam 26 couples the one of the one or more straps 22 to the back panel 34. The one or more straps 22 includes an adjuster 38 and a coupler 40. The strip of fabric 28 extends along the second edge 36*b*. The strip of fabric 28 is coupled to at least the one of the one or more straps 22 and the back panel 34 via stitching. A band 30 extends along at least the third edge 26*c*. The band 30 is coupled to at least the one of the one or more straps 22 and the strip of fabric 28 via stitching. The second side 14 mirrors the first side 12 and includes similar components as described herein for the first side 12. The band 30 is the same for the first side 12 as for the second side 14, as the band 30 extends at least along a back width of a torso of the wearer 16.

In some embodiments, the swimsuit 10 may come in a variety of patterns, styles, and colors. The swimsuit 10 may include one or more types of fabric. In some embodiments, the fabric is ribbed. In one or more embodiments, the swimsuit 10 may include additional fabric such that it is a one-piece swimsuit, tankini, long sleeve swimsuit, monokini, triangle-top, bandeau, strapless, and the like. In some embodiments, the swimsuit 10 is designed for wearers who are small-chested. In one or more embodiments, the swimsuit 10 is designed for wearers, who are sized to wear AA, A, and/or B cups.

In one or more embodiments, the first side 12 differs from the second side 14 by one or more components. For example, in one embodiment, the first side 12 may include one or more straps 22, however, the second side 14 may include no straps. In some embodiments, the first side 12 extends from the middle of the sternum of the wearer 16 to the middle of the spine on the proper right side of the wearer 16, and the second side 14 extends from the middle of the sternum of the wearer 16 to the middle of the spine on the proper left of the wearer 16.

Figure 3A:
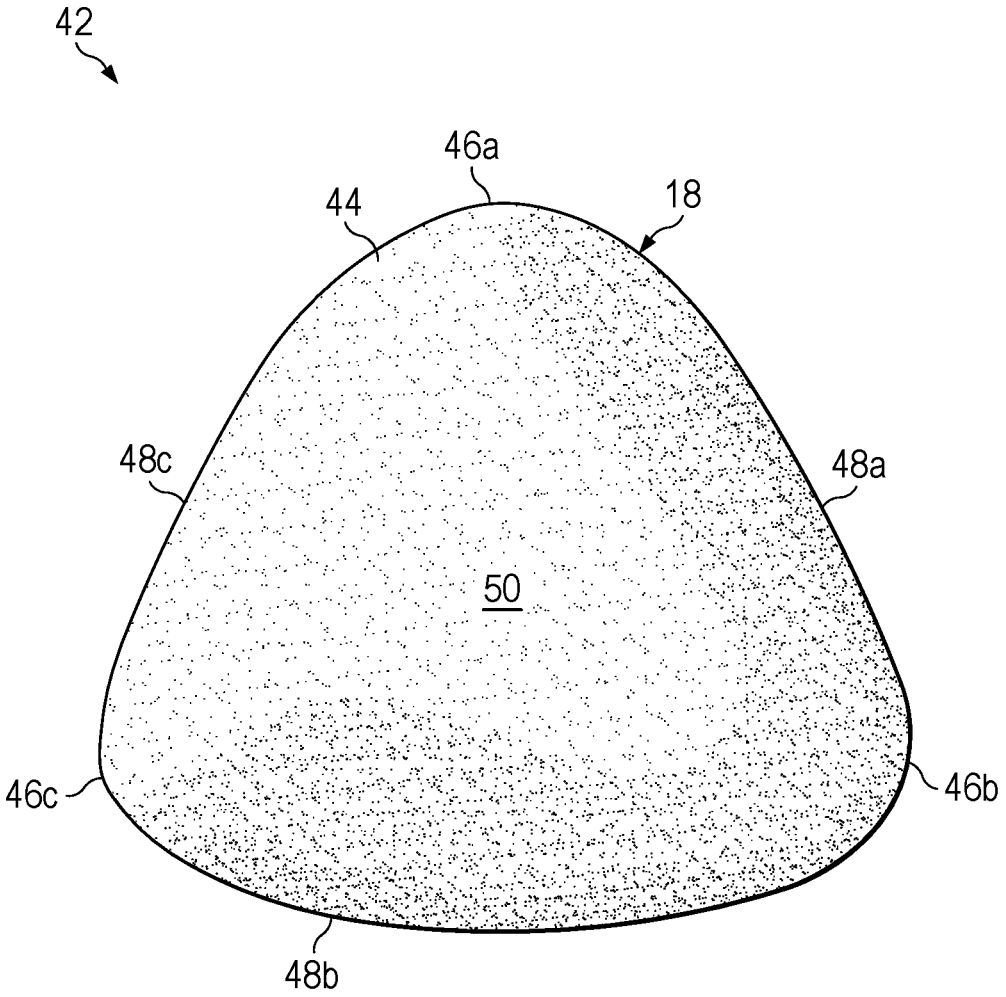
FIG. 3A is a front view of one of the inserts of FIG. 1, according to one or more embodiments.

Referring to FIG. 3A with continuing reference to FIGS. 1 and 2, a front view of the non-removable insert 18 of swimsuit 10 for small chested wearers is generally referred to by reference numeral 42 and includes the front side 44. The front side 44 includes a first corner 46*a*, a second corner 46*b*, and a third corner 46*c* and a first border 48*a*, a second border 48*b*, and a third border 48*c*. The first corner 46*a*, the second corner 46*b*, and the third corner 46*c* are each a rounded corner. The perimeter of the non-removable insert 18 is defined by the first border 48*a*, which extends from the first corner 46*a* to the second corner 46*b*, the second border 48*b*, which extends from the second corner 46*b* to the third corner 46*c*, and the third border 48*c*, which extends from the third corner 46*c* to the first corner 46*a*. When worn by the wearer 16 on the first side 12 of the swimsuit 10, the first border 48*a* is placed toward the outside of the breast, the third border 48*c* is placed closest to the other breast, and the first corner 46*a* is positioned above the nipple of the wearer 16. When worn by the wearer 16 on the second side 14 of the swimsuit, the first border 48*a* is placed closer to the other breast, the third border 48*c* is placed toward the outside of the breast, and the first corner 46*a* is positioned above the nipple of the wearer 16. The front side 44 includes a crest 50, which represents a peak of the non-removable insert 18. The crest 50 is positioned closer to the second corner 46*b* and the third corner 46*c*, than the first corner 46*a*. The crest 50 is a portion of the non-removable insert 18 that is raised higher than the remainder of the portions of the non-removable insert 18.

Figure 3B:
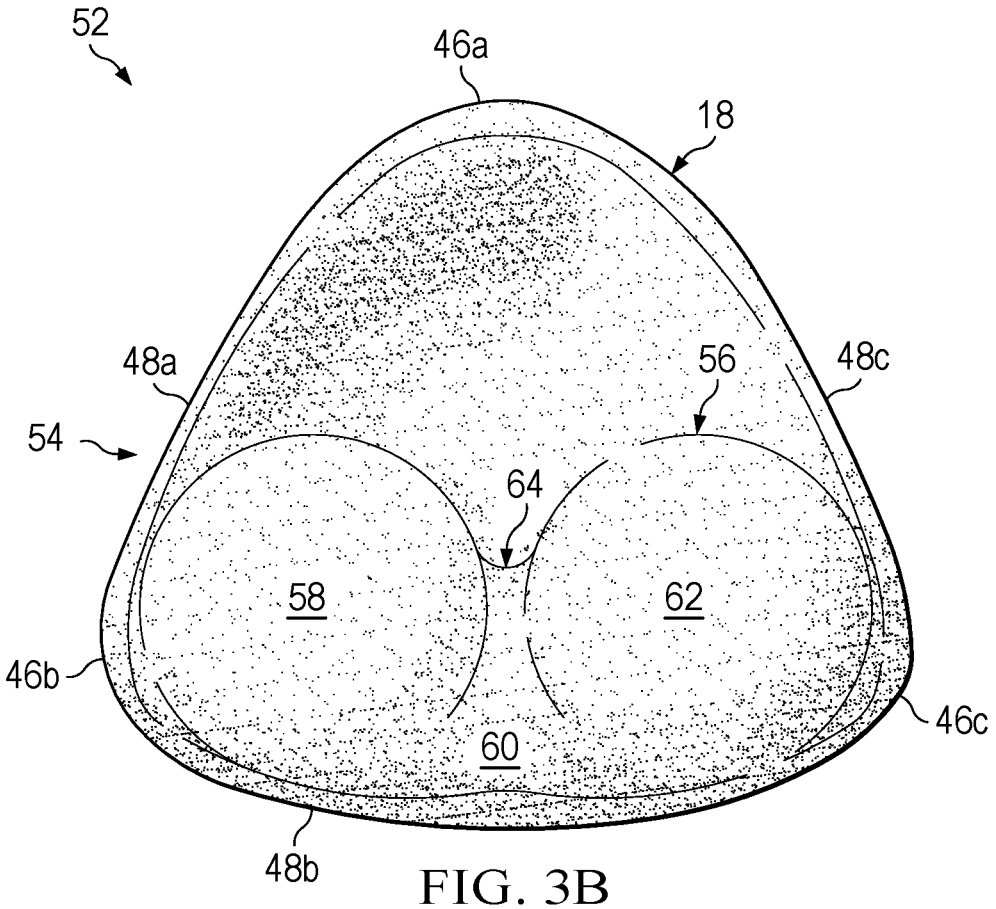
FIG. 3B is a back view of one of the inserts of FIG. 1, according to one or more embodiments.

Referring to FIG. 3B with continuing reference to FIGS. 1-3A, a back view of the non-removable insert 18 of swimsuit 10 for small chested wearers is generally referred to by reference numeral 52 and includes the back side 54. The back side 54 of the non-removable insert 18 when placed in the swimsuit 10 is closest to the wearer 16. The front side 44 of the non-removable insert 18 is further from the wearer 16 than the back side 54 of the non-removable insert 18. The back side 54 of the non-removable insert 18 is placed closer to the back panel 34 than the front panel 20. The front side 44 of the non-removable insert 18 is positioned closer to the front panel 20 than the back panel 34. The front side 44 of the non-removable insert 18 and the back side 54 of the non-removable insert 18 are opposing sides. The back side 54 includes the first corner 46*a*, the second corner 46*b*, and the third corner 46*c* and the first border 48*a*, the second border 48*b*, and the third border 48*c*. The first corner 46*a*, the second corner 46*b*, and the third corner 46*c* are rounded corners, respectively. The perimeter of the non-removable insert 18 is defined by the first border 48*a*, which extends from the first corner 46*a* to the second corner 46*b*, the second border 48*b*, which extends from the second corner 46*b* to the third corner 46*c*, and the third border 48*c*, which extends from the third corner 46*c* to the first corner 46*a*. The back side 54 includes a raised portion 56. The raised portion 56 extends along a portion of the second border 48*b* and is closer to the second corner 46*b* and the third corner 46*c* than to the first corner 46*a*. The raised portion 56 includes a first sub-portion 58, a second sub-portion 60, and a third sub-portion 62. The second sub-portion 60 is positioned between the first sub-portion 58 and the third sub-portion 62. The second sub-portion 60 includes an indentation 64. The second sub-portion 60 is smaller than the first sub-portion 58 and the third sub-portion 62 due to the indentation 64. The nipple of the wearer 16 may be positioned in the indentation 64 and/or above the second sub-portion 60 when worn. The thickness of the non-removable insert 18 is greatest at the raised portion 56 of the back side 54. The thickness of the non-removable insert 18 is the least near the first corner 46*a* of the back side 54 of the non-removable insert 18.

Figure 3C:
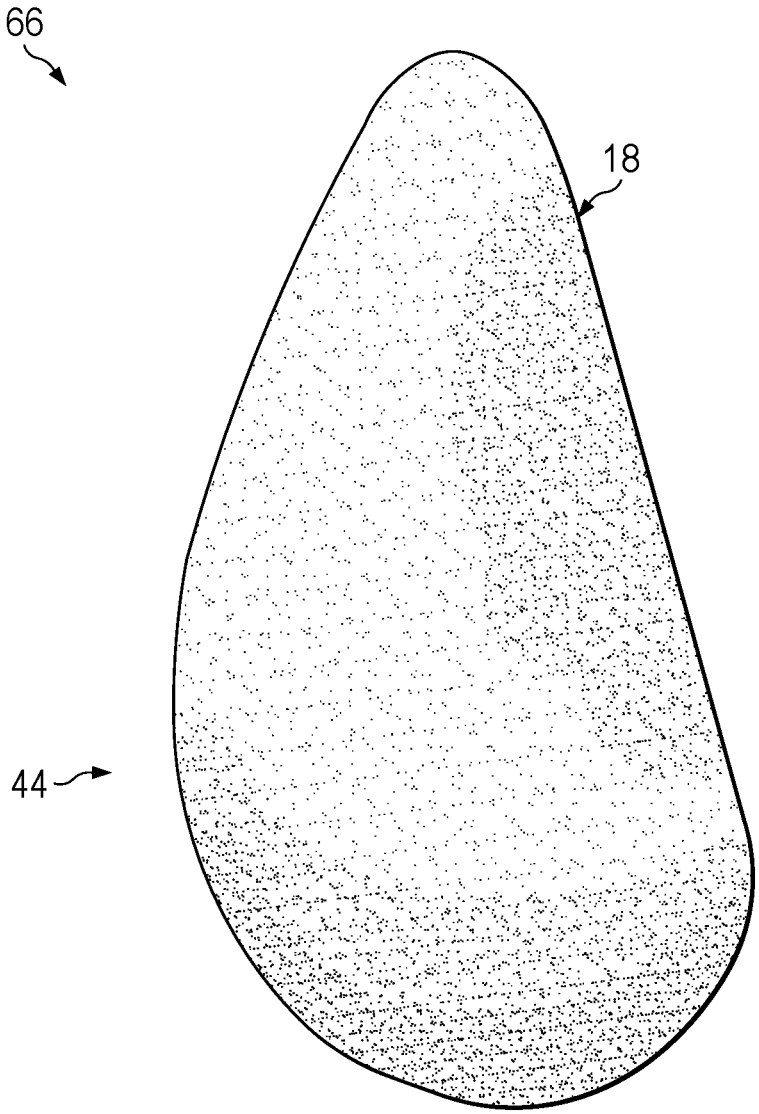
FIG. 3C is a perspective front view of one of the inserts of FIG. 1, according to one or more embodiments.

Referring to FIG. 3C with continuing reference to FIGS. 1-3B, a perspective front view of the non-removable insert 18 of swimsuit 10 for small chested wearers is generally referred to by reference numeral 66 and includes the front side 44.

Figure 3D:
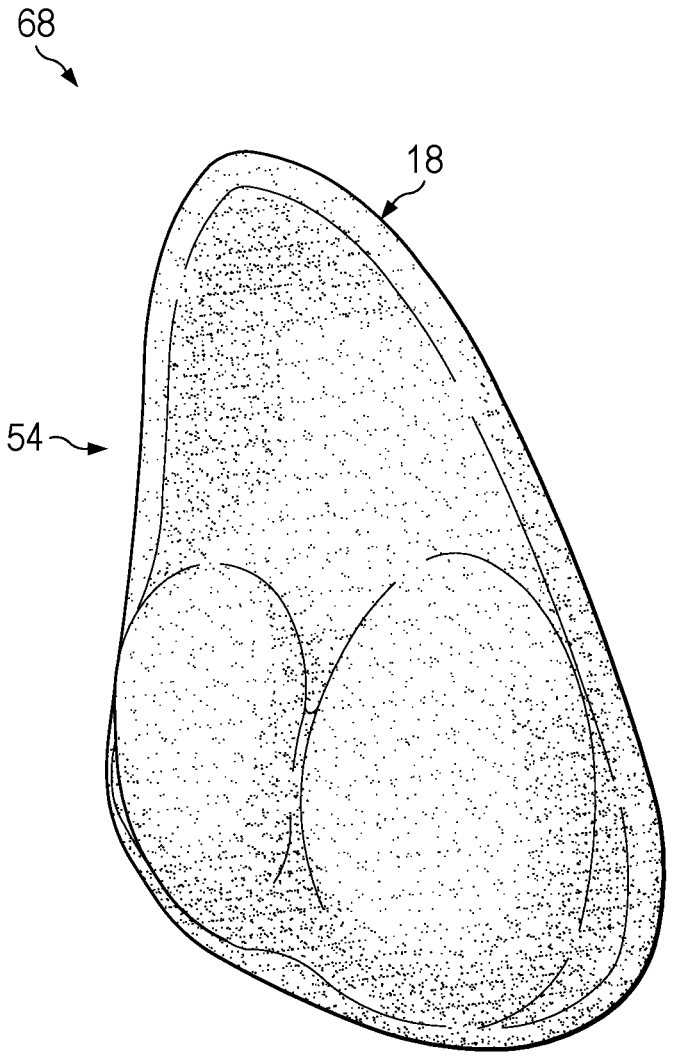
FIG. 3D is a perspective back view of one of the inserts of FIG. 1, according to one or more embodiments.

Referring to FIG. 3D with continuing reference to FIGS. 1-3C, a perspective back view of the non-removable insert 18 of swimsuit 10 for small chested wearers is generally referred to by reference numeral 68 and includes the back side 54.

With continuing reference to FIGS. 1-3D, in some embodiments, the non-removable insert 18 is a silicone-based insert that includes a front side 44 and a back side 54. The front side 44 of the non-removable insert 18, in some embodiments, is triangular shaped and smooth across the entirety of the front side 44 of the non-removable insert 18. In some embodiments, the first, second, and third borders 48*a*, 48*b*, and 48*c*, respectively, define the triangular shape of the front side 44 of the non-removable insert 18. In some embodiments, the first, second, and third borders 48*a*, 48*b*, and 48*c*, respectively, define a perimeter of the front side 44 of the non-removable insert 18. The back side 54, in some embodiments, is also triangular shaped and defined by the first, second, and third borders 48*a*, 48*b*, and 48*c*, respectively, but includes a portion that extends away from the back side and toward the wearer. In some embodiments, the first, second, and third borders 48*a*, 48*b*, and 48*c*, respectively, define a perimeter of the back side 54 of the non-removable insert 18. In some embodiments, the rounded corners 46*a*, 46*b*, and 46*c*, respectively, are instead sharp corners.

In one or more embodiments, the non-removable insert 18 may be clear, nude, or any other color. In some embodiments, the non-removable insert 18 includes rounded edges and/or rounded shapes to mimic the organic, human shape. In some embodiments, the first sub-portion 58 and the third sub-portion 62 are identical in size and shape. In other embodiments, the first sub-portion 58 differs from the third sub-portion 62. In some embodiments, the first sub-portion 58 and the third sub-portion 62 have rounded edges. In some embodiments, the first sub-portion 58, the second sub-portion 60, and the third sub-portion 62 are integrally formed with the remainder of the non-removable insert 18. In some embodiments, the first sub-portion 58, the second sub-portion 60, and the third sub-portion 62 are contiguous. In other embodiments, the first sub-portion 58, the second sub-portion 60, and the third sub-portion 62 are non-contiguous. In some embodiments, the indentation 64 in the second sub-portion 60 may be smaller or larger. In some embodiments, the non-removable insert 18 is made up of a combination of at least one or more of: dimethicone, vinyl silicone oil, anionic polymer, and expandable microsphere. In some embodiments, the non-removable insert 18 is made substantially of silicone. In one or more embodiments, the non-removable insert 18 is made up of dimethicone, vinyl silicone oil, anionic polymer, and expandable microsphere. In other embodiments, the non-removable insert 18 is made up of at least two of: dimethicone, vinyl silicone oil, anionic polymer, and expandable microsphere. In other embodiments, the non-removable insert 18 is made substantially of silicone. In some embodiments, the non-removable insert 18 may have clear film surrounding the non-removable insert 18. In some embodiments, the clear film extends past the non-removable insert 18.

In some embodiments, the non-removable insert 18 may be in a different shape than a triangle. For example, the different shape may be, but not limited to, an inverted triangle with rounded edges, a rectangle, a triangle to one side of the insert, a crescent shape, oval shape, or the like. In some embodiments, the non-removable insert 18 in the first side 12 and the non-removable insert 18 on the second side 14 are identical. In other embodiments, the non-removable insert 18 is shaped specifically for the left breast or right breast. In one or more embodiments, the non-removable insert 18 may be replaced with one of the other non-removable inserts discussed herein.

In one or more embodiments, the front panel 20 is shaped like a triangle with three sides. In one or more embodiments, the front panel 20 is a triangular-like shape but is a quadrilateral. In some embodiments, the front panel 20 is a shape such as a crescent, circular, or the like.

In some embodiments, the one or more straps 22 are pleated, ruched, or puckered. In some embodiments, the one or more straps 22 are the same material, color, and/or fabric as the front panel 20. In some embodiments, the one or more straps 22 are a different material, fabric, and/or color than the front panel 20. In one or more embodiments, the same piece of fabric is used to make the one or more straps 22 and the front panel 20. In one or more embodiments, one or more straps 22 are fully removable. In one or more embodiments, the one or more straps 22 are removable from one portion of the swimsuit 10. In some embodiments, the one or more straps 22 are removable at the coupler 40. In one or more embodiments, the one or more straps 22 are adjustable using the adjuster 38 such that the wearer 16 can make the straps longer or shorter in length. In one or more embodiments, the one or more straps 22 are not adjustable in length and do not include an adjuster 38. In some embodiments, no straps are included in swimsuit 10. In other embodiments, a plurality of straps is included on the first side 12 and/or the second side 14. In other embodiments, one strap of the one or more straps 22 may extend from the first side 12 to the second side 14 of the wearer 16 and vice versa.

In one or more embodiments, the first edge 24*a*, the second edge 24*b*, and the third edge 24*c* of the front panel 20 define the boundaries of the front panel 20 that are visible. In one or more embodiments, one or more portions of the front panel 20 extends past the first edge 24*a*, the second edge 24*b*, and the third edge 24*c*. However, the one or more portions are not visible. In some embodiments, the first edge 24*a*, the second edge 24*b*, and the third edge 24*c* are created by binding, facing, or a similar sewing technique. In some embodiments, instead of using a separate piece of fabric to finish the edges of the front panel 20, the front panel 20 is instead folded and hemmed to create a finished edge. In some embodiments, a piece of fabric (such as the strip of fabric 28, the band 30, and/or the one or more straps 22) is placed over an edge of the front panel 20 and sewn. The seam allowance is the distance from the seam (such as seam 26) to an edge of the piece of the fabric. In some embodiments, the first edge 24*a*, the second edge 24*b*, and/or the third edge 24*c* is the edge of the piece of fabric-because the edge of the piece of fabric marks the beginning of the front panel that is visible. In some embodiments, the one or more straps 22 extend from the band 30 along the first edge 24*a* over a shoulder and back of wearer 16 and reconnects at the band 30 via the coupler 40. In one or more embodiments, a separate piece of fabric follows the first edge 24*a* rather than the one or more straps 22. In some embodiments, the separate piece of fabric is coupled to the one or more straps 22, the band 30, and the front panel 20.

In some embodiments, the seam 26 may be a double-stitched seam, which may provide a stronger seam than a single stitched seam. The seam 26, in some embodiments, may be a single stitched seam. Similar seams to seam 26 may be used to couple the band 30 to the front panel 20, couple the strip of fabric 28 to the front panel, band 30, and/or the one or more straps 22, and/or couple the one or more straps to the front panel 20, the band 30, and/or the strip of fabric 28.

In some embodiments, the strip of fabric 28 is the one or more straps 22. In some embodiments, the strip of fabric 28 is a portion of the front panel 20 that is folded and sewn. The strip of fabric 28, in some embodiments, is inserted into a portion of the one or more straps 22 and sewn and/or inserted into a portion of the band 30 and sewn.

In some embodiments, the band 30 is continuous. In some embodiments, the band 30 is non-continuous. In some embodiments, the band 30 includes elastic. In one or more embodiments, the band 30 is a singular piece of fabric. In one or more embodiments, the band 30 may have two portions that may be tied together to be adjustable by the wearer 16 and be securable by the wearer 16. In some embodiments, the band 30 includes a clasp. In some embodiments, the clasp is decorative and serves no function. In other embodiments, the clasp is functional and may be opened to separate the first side 12 from the second side 14. In other embodiments, the clasp is functional and may be opened to separate the second side 14 from the first side 12. In some embodiments, the clasp is colored gold. In some embodiments, the band 30 includes any one of: a slide hook, a hook and eye closure, clicker closure, or the like. In some embodiments, the band 30 extends around the perimeter of the wearer continuously. The swimsuit also may include a band size for the band 30. The band size of the swimsuit may vary. In some embodiments, one portion of the band 30 may extend along at least the route of the third edge 36*c*, and another portion of the band 30 is separated from the third edge 36*c* by the wearer 16.

In some embodiments, the back panel 34 is the same size as the front panel 20. In some embodiments, the back panel 34 is a different size as the front panel 20. In one or more embodiments, the back panel 34 is a different material or color than the front panel 20. In some embodiments, the back panel 34 and the front panel 20 are connected and made from a single piece of fabric. In some embodiments, one or more portions of the back panel 34 extends past the first edge 36*a*, the second edge 36, and the third edge 36*c*. However, the one or more portions are not visible. In some embodiments, the first edge 36*a*, the second edge 36*b*, and the third edge 36*c* are created by binding, facing, or a similar sewing technique. In some embodiments, instead of using a separate piece of fabric to finish the edges of the back panel 34, the back panel 34 is instead folded and hemmed to create a finished edge. In some embodiments, a piece of fabric (such as the strip of fabric 28, the band 30, and/or the one or more straps 22) is placed over an edge of the back panel 34 and sewn. The seam allowance is the distance from the seam (such as seam 26) to an edge of the piece of the fabric. In some embodiments, the first edge 36*a*, the second edge 36*b*, and/or the third edge 36*c* is the edge of the piece of fabric-because the edge of the piece of fabric marks the beginning of the back panel 34 that is visible. In some embodiments, the one or more straps 22 extend from the band 30 along the first edge 36*a* over a shoulder and back of wearer 16 and reconnects at the band 30 via the coupler 40. In one or more embodiments, a separate piece of fabric follows the first edge 36*a* rather than the one or more straps 22. In some embodiments, the separate piece of fabric is coupled to the one or more straps 22, the band 30, and the back panel 34. In some embodiments, the seam 26 (as shown in FIG. 2) is the back of the stitching.

In some embodiments, the adjuster 38 allows the wearer 16 to adjust the length of the one or more straps 22. In one or more embodiments, the adjuster 38 is omitted. In some embodiments, the adjuster 38 is a strap adjuster, a slide adjuster, a double-loop adjustor, or the like. In some embodiments, the adjuster 38 is made of metal, plastic, or the like.

In one or more embodiments, the coupler 40 is directly coupled to the band 30. In some embodiments, the coupler 40 is attached to a piece of fabric coupled to the band 30. In some embodiments, the coupler 40 is made of metal, plastic, or the like. In some embodiments, the coupler 40 is a rigid or semi-rigid. In one or more embodiments, the coupler 40 is a circular coupler of a fixed circumference. In some embodiments, the coupler 40 is coupled to the one or more straps 22. In some embodiments, the coupler 40 is removable such that the one or more straps 22 are removable. In some embodiments, a coupler 40 is placed on each end of the one or more straps 22. In some embodiments, the one or more straps 22 is sewn and coupled to the coupler 40. In some embodiments, the one or more straps 22 comprise a hook or similar device that attaches to the coupler 40.

In operation, with continuing reference to FIGS. 1-3D, the non-removable insert 18 is disposed between the front panel 20 and the back panel 34. A strip of fabric 28 is placed around the second edges 24*b* and 36*b*, respectively. The one or more straps 22 is positioned around the first edges 24*a* and 36*a* and over a portion of the strip of fabric 28. The band 30 is placed along the third edges 24*c* and 36*c*. Then, using a double stitched seam (including seam 26), the strip of fabric 28 is sewn along the second edges 24*b* and 36*b*, the one or more straps 22 is sewn along the first edges 24*a* and 36*a*, and the band is sewn along the third edges 24*c* and 36*c* such that the first edges 24*a* and 36*a*, the second edges 24*b* and 36*b*, and the third edges 24*c* and 36*c* are encased by the one or more straps 22, the strip of fabric 28, and the band 30 respectively, and an interior region is created that houses the non-removable insert 18.

In some embodiments, the interior region created permits the non-removable insert 18 relative movement within the interior region. In some embodiments, the interior region may have an opening to remove the non-removable insert 18. In some embodiments, the interior region has hook and loop or a zipper to allow access to the non-removable insert 18. In some embodiments, the non-removable insert 18 fills the entire width of the front panel 20 and/or the back panel 34 and does not move along the width. In some embodiments, the non-removable insert 18 fills the entire length of the front panel 20 and/or the back panel 34 and does not move along the length. In some embodiments, the stitching around the front panel 20 and the back panel 34 prevents the non-removable insert 18 from being removed. In some embodiments, the non-removable insert 18 may move but only within the interior region created by the front panel 20 and the back panel 34 and may not be taken out of the interior region. In some embodiments, the non-removable insert 18 may be stitched directly to either the front panel 20 and/or the back panel 34. In some embodiments, the non-removable insert 18 is coupled to the front panel 20 and/or the back panel 34 via glue.

Figure 4:
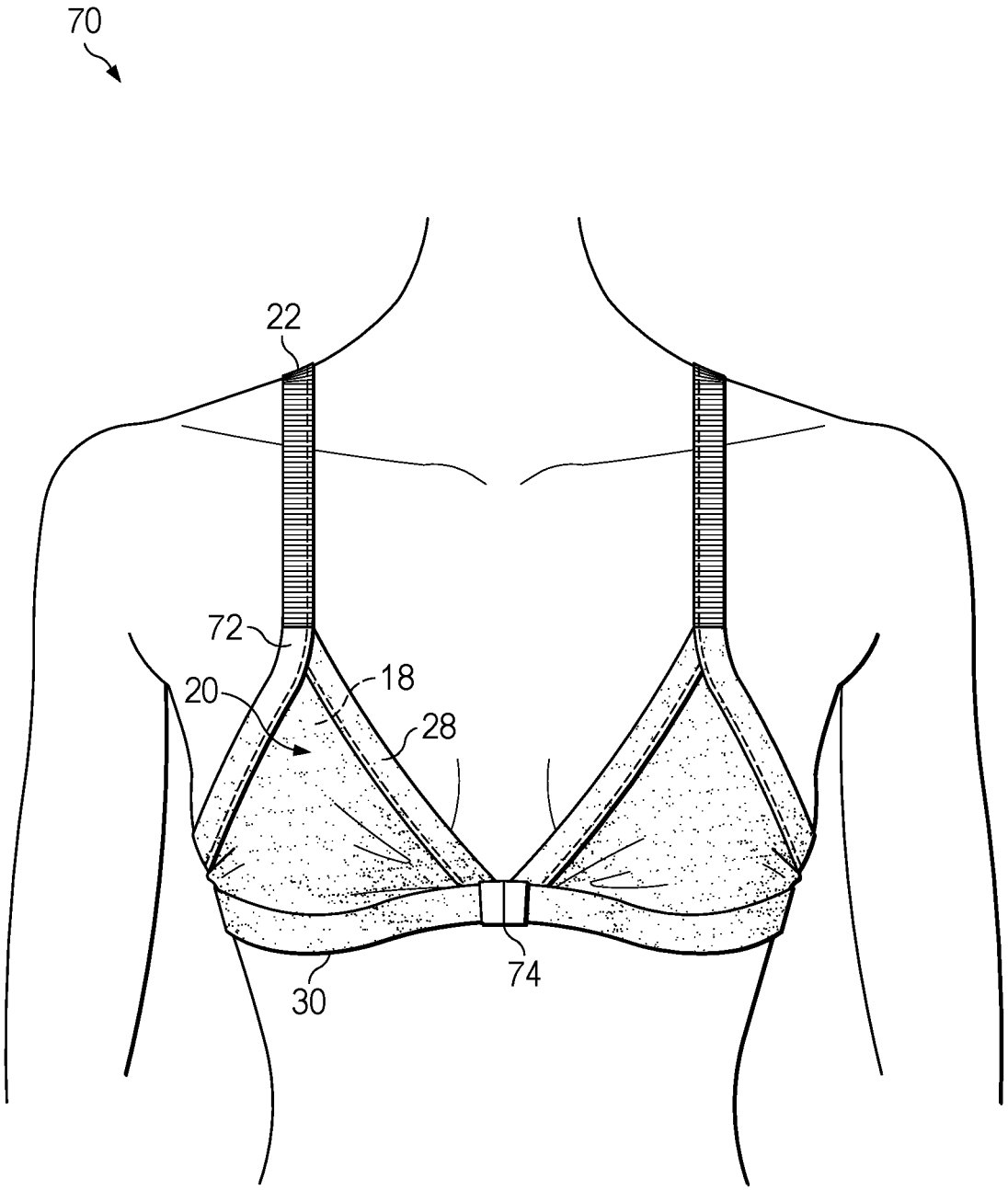
FIG. 4 is another diagrammatic illustration of a swimsuit, according to one or more embodiments.

Referring to FIG. 4, in another embodiment, a swimsuit for small chested wearers is generally referred to by reference numeral 70 and includes several components of the swimsuit 10 of FIGS. 1-3D, which components are given the same reference numerals. The swimsuit 70 includes the non-removable insert 18, the front panel 20, the one or more straps 22, the strip of fabric 28, and the band 30. The one or more straps 22 are coupled to a strip of cloth 72. The strip of cloth 72 extends along the first edge 24*a*. The strip of cloth 72 is coupled to at least the one of the one or more straps 22 and the front panel 20 via stitching. The one or more straps 22 include two straps that are ruched. The band 30 includes a clasp 74.

In one or more embodiments, the two straps of the one or more straps 22 are a different fabric from any one or more of: the strip of cloth 72, the band 30, and the strip of fabric 28. In one or more embodiments, the two straps are flat and not ruched, puckered, or the like.

In some embodiments the strip of cloth 72 is similar to the strip of fabric 28. In some embodiments, the strip of cloth 72 is the same material, fabric, color, and the like as the strip of fabric 28. In some embodiments, the strip of cloth 72 is also coupled to the band 30. In some embodiments, the strip of cloth 72 ends prior to the band 30 and is not coupled to the band 30. In some embodiments, the strip of cloth 72 is coupled to the front panel and/or the one or more straps using a double-stitched seam. In other embodiments, the strip of cloth 72 uses a single-stitched seam for coupling.

In one or more embodiments, the clasp 74 may be decorative. In some embodiments, the clasp 74 is functional and joins two ends of the band 30 together. The clasp 74, in some embodiments, a slide hook, a hook and eye closure, clicker closure, or the like. In some embodiments, the clasp 74 may be positioned on the opposite side of the band 30 such that it is near the back of the wearer 16.

Figure 5:
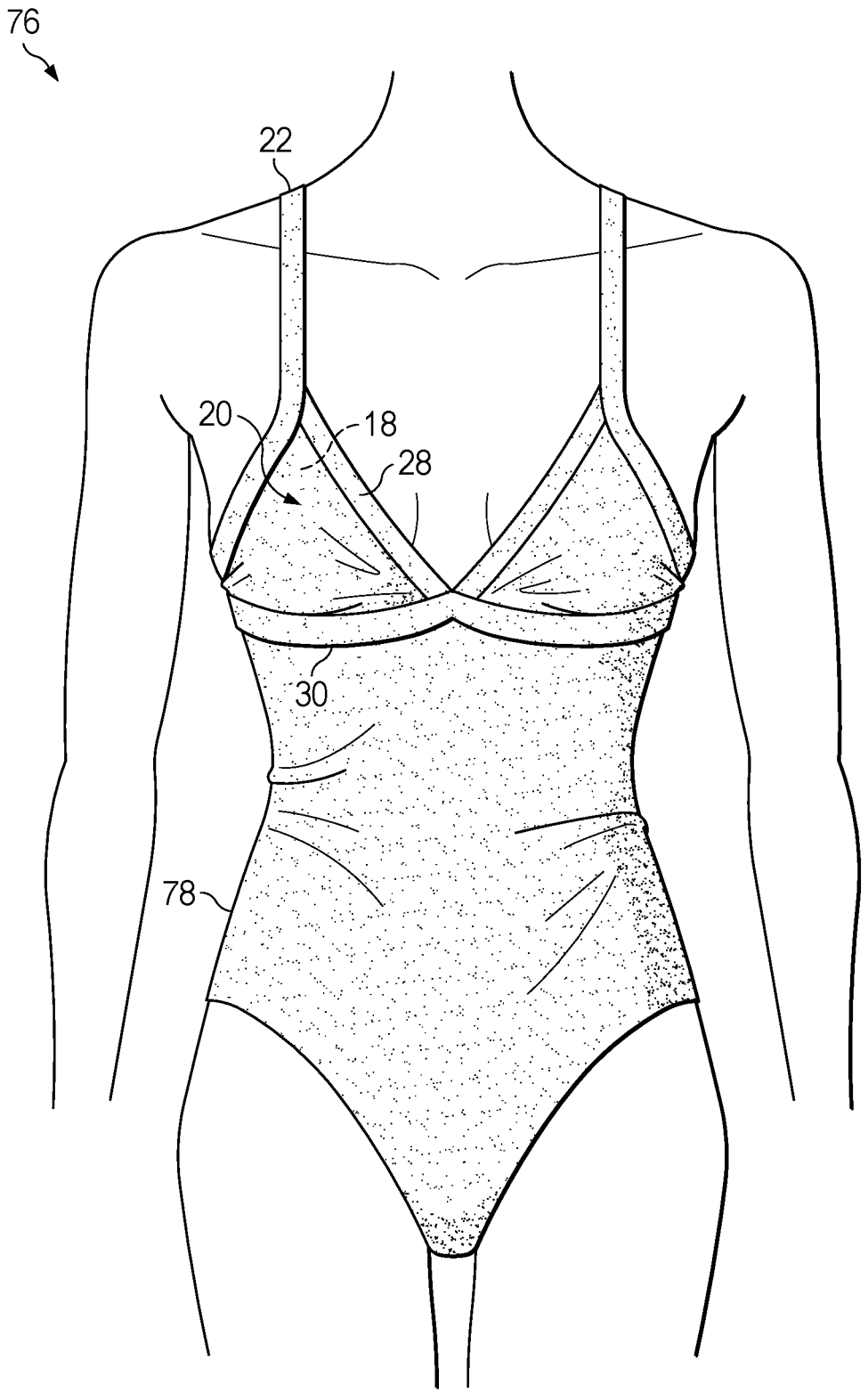
FIG. 5 is yet another diagrammatic illustration of a swimsuit, according to one or more embodiments.

Referring to FIG. 5, in another embodiment, a swimsuit for small chested wearers is generally referred to by reference numeral 76 and includes several components of the swimsuit 10 of FIGS. 1-3D, which components are given the same reference numerals. The swimsuit 76 includes the non-removable insert 18, the front panel 20, the one or more straps 22, the strip of fabric 28, and the band 30. The swimsuit 76 includes a bottom portion 78. The bottom portion 78 is coupled under the band 30 to the front panel 20. The bottom portion 78 extends from the third edge 24*c* around the bottom of the wearer 16 to the back of the wearer 16 such that the bottom portion forms a one-piece swimsuit.

In some embodiments, the band 30 is removed. In some embodiments the band 30 extends only along a front, width of the torso of the wearer 16. In one or more embodiments, the band does not extend fully around the wearer 16.

In one or more embodiments, the bottom portion 78 includes slits, holes, or the like such that the swimsuit 76 is a monokini. In one or more embodiments, the bottom portion 78 ends at or above the hip bone of the wearer 16 such that a tankini is formed. In some embodiments, the bottom portion 78 is made up of a plurality of pieces of fabric sewn together. In some embodiments, the one or more straps 22 attach in the back to the bottom portion 78 rather than to the band 30. In one or more embodiments, the bottom portion 78 includes a belt that wraps fully around the waist of the wearer 16.

In operation and with continuing reference to FIGS. 1-5, the swimsuit (swimsuit 10, swimsuit 70, or swimsuit 76) is worn by the wearer 16, who is considered small-chested, generally AA-B cup. The swimsuit (swimsuit 10, swimsuit 70, or swimsuit 76) is made to include two pieces of fabric (e.g., front panel 20 and back panel 34) that fully enclose the non-removable inserts (e.g., non-removable insert 18) via stitching. The non-removable insert 18 is designed to stay in place both in the swimsuit (swimsuit 10, swimsuit 70, or swimsuit 76) and on the wearer 16 wearing the swimsuit (swimsuit 10, swimsuit 70, or swimsuit 76). The non-removable insert 18 contours to a breast of the wearer 16 and provides a gentle lift of the breast.

In some embodiments, the non-removable insert 18 is placed such that the second border 48*b* is below the breast and the non-removable insert 18 is centered on the breast in order to provide a gentle lift up, rather than being pushed closer together, which contours the non-removable insert 18 to the breast.

In other embodiments, the non-removable insert 18 is placed toward the outside of the breast, rather than being centered on the breast. By placing the non-removable insert 18 to the outside, a different form of lift of the breasts is provided by the swimsuit (swimsuit 10, swimsuit 70, or swimsuit 76), which contours the non-removable insert 18 to the breast. The breasts would be lifted and pushed closer together.

Figure 6:
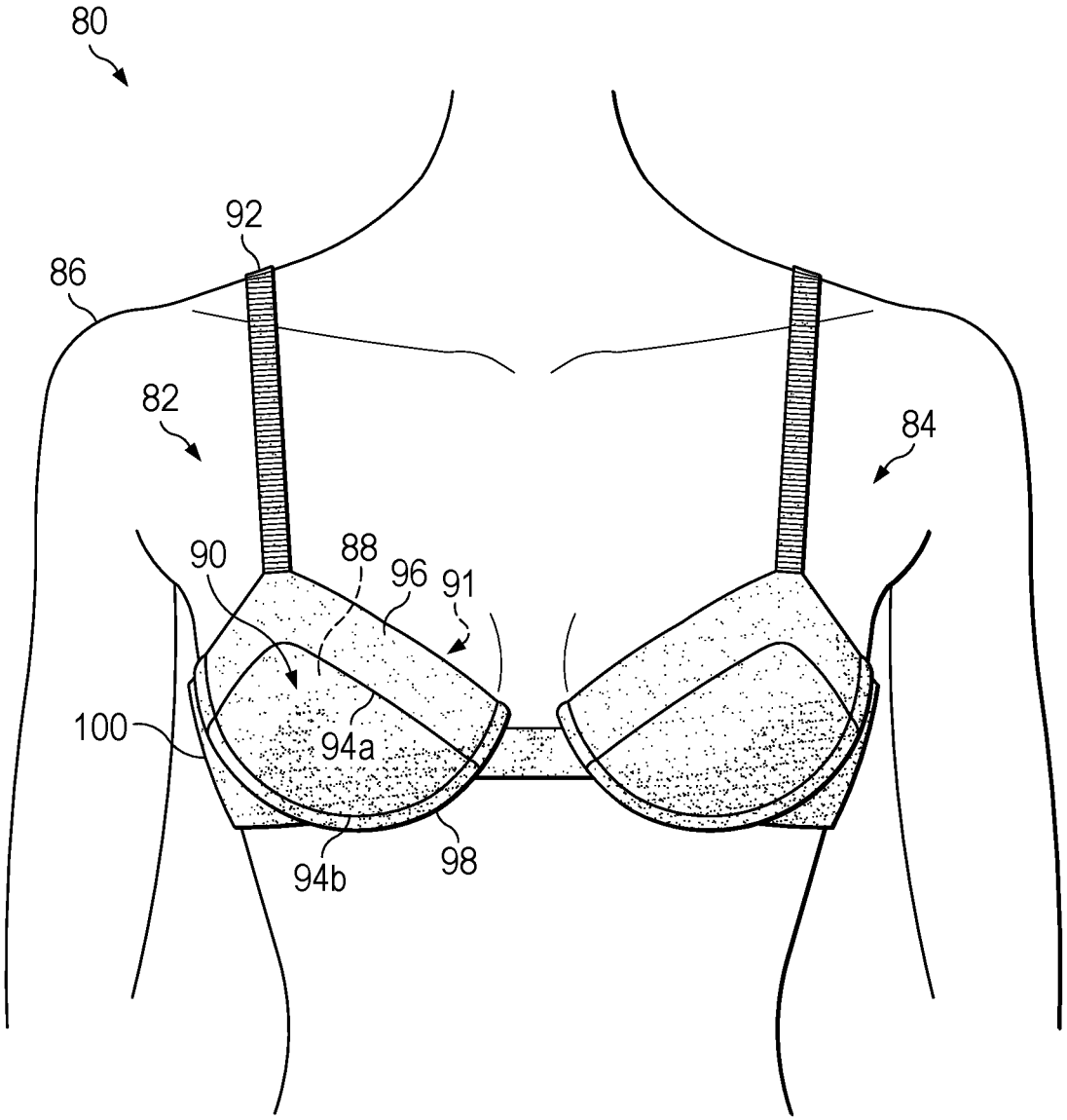
FIG. 6 is a diagrammatic illustration of a front view of a swimsuit that includes two inserts, according to one or more embodiments.

Referring to FIG. 6, in an embodiment, a swimsuit for small chested wearers is generally referred to by reference numeral 80 and includes a first side 82 and a second side 84. The first side 82 is defined by being located substantially on the proper right side of a wearer 86 and includes a non-removable insert 88 (indentations from the non-removable insert 88 may be visible but otherwise, the non-removable insert 88 is not shown), a front panel 90, a back panel 91, and one or more straps 92. The non-removable insert 88 is disposed behind the front panel 90 and in front of the back panel 91. The front panel 90 is bound by a first edge 94*a* and a second edge 94*b*. A first strip of fabric 96 extends along the first edge 94*a*. The one of the one or more straps 22 is coupled to the first strip of fabric 96 via stitching. The first strip of fabric 96 is coupled to the front panel 90 via stitching along the first edge 94*a* and coupled to the back panel 91 via stitching (not shown). A second strip of fabric 98 extends along at least a portion of the second edge 94*b*. The second strip of fabric 98 is coupled to the front panel 90 via stitching along at least a portion of the second edge 94*b* and to the back panel via stitching (not shown). The band 100 is coupled to the second strip of fabric 98. The second side 84 is on the proper left side of the wearer 86. The second side 84 mirrors the first side 82 and includes similar components as described herein for the first side 82. The band 100 is the same for the first side 82 as for the second side 84, as the band 100 couples the first side 82 to the second side 84.

In some embodiments, the first side 82 differs from the second side 84. For example, the first side 82 may include one or more straps 92, while the second side 84 may include no straps. In some embodiments, the first side 82 extends from the middle of the sternum to the middle of the spine on the proper right side of the wearer 86. In other embodiments, the first side 82 extends from the middle of the sternum to the axilla of the wearer 86 axilla on the proper right side of the wearer 86. In some embodiments, the second side 84 extends from the middle of the sternum to the middle of the spine on the proper left side of the wearer 86. In other embodiments, the second side 84 extends from the middle of the sternum to the axilla on the proper left side of the wearer 86. In some embodiments, the first side 82 connects to the second side 84 by a clasp, buckle, a tied ribbon, a piece of fabric (such as the band 100), or the like.

Figure 7A:
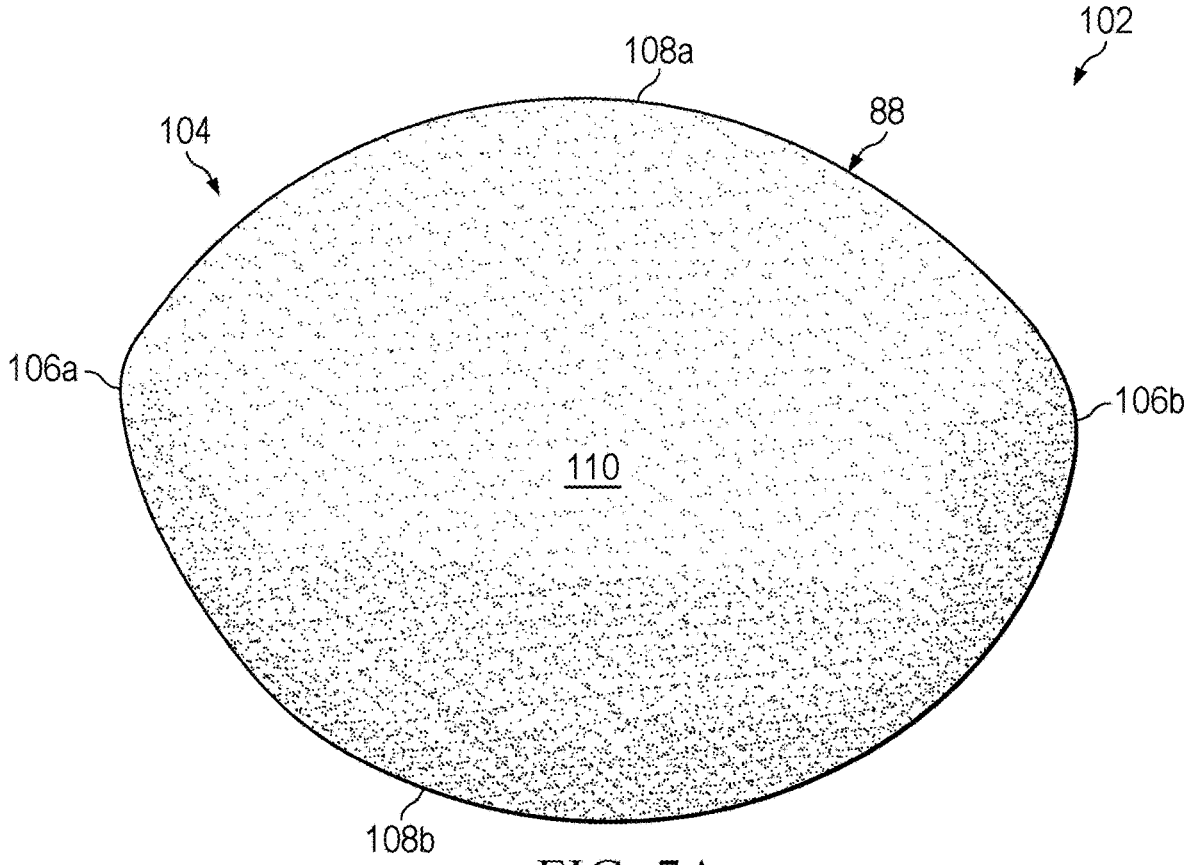
FIG. 7A is a front view of one of the inserts of FIG. 6, according to one or more embodiments.

Referring to FIG. 7A with continuing reference to FIG. 6, a front view of the non-removable insert 88 of swimsuit 80 for small chested wearers is generally referred to by reference numeral 102 and includes the front side 104. The front side 104 includes a first corner 106*a* and a second corner 106*b*. The second corner 106*b* opposes the first corner 106*a*. The front side 104 of the non-removable insert 88 includes a first border 108*a* and a second border 108*b*. The perimeter of the non-removable insert 88 is defined by the first border 108*a*, which extends from the first corner 106*a* to the second corner 106*b* and the second border 108*b*, which extends from the second corner 106*b* to the first corner 106*a*. When worn by the wearer 86 on the first side 82 of the swimsuit 80, the first border 108*a* is placed above the nipple of the breast and the second border 108*b* is placed under the nipple of the breast such that the nipple of the breast is placed in between the first border 108*a* and the second border 108*b*. When worn by the wearer 86 on the first side 82 of the swimsuit 80, the first corner 106*a* is positioned toward the outside of the breast, and the first corner 106*a* is further from the other breast of the wearer 86 than the second corner 106*b*, which is positioned opposite the first corner 106*a*. When worn by the wearer 86 on the second side 84 of the swimsuit 80, the first border 108*a* is placed above the nipple of the breast and the second border 108*b* is placed under the nipple of the breast such that the nipple of the breast is placed in between the first border 108*a* and the second border 108*b*. When worn by the wearer 86 on the second side 84 of the swimsuit 80, the second corner 106*b* is positioned toward the outside of the breast, and the second corner 106*b* is further from the other breast of the wearer 86 than the first corner 106*a*, which is positioned opposite the second corner 106*b*. The front side 104 includes a crest 110, which represents a peak of the non-removable insert 88. The crest 110 is positioned between the first corner 106*a* and the second corner 106*b* and disposed between the first border 108*a* and the second border 108*b*. The crest 110 is a portion of the non-removable insert 88 that is raised higher than the remainder of the portions of the non-removable insert 88.

Figure 7B:
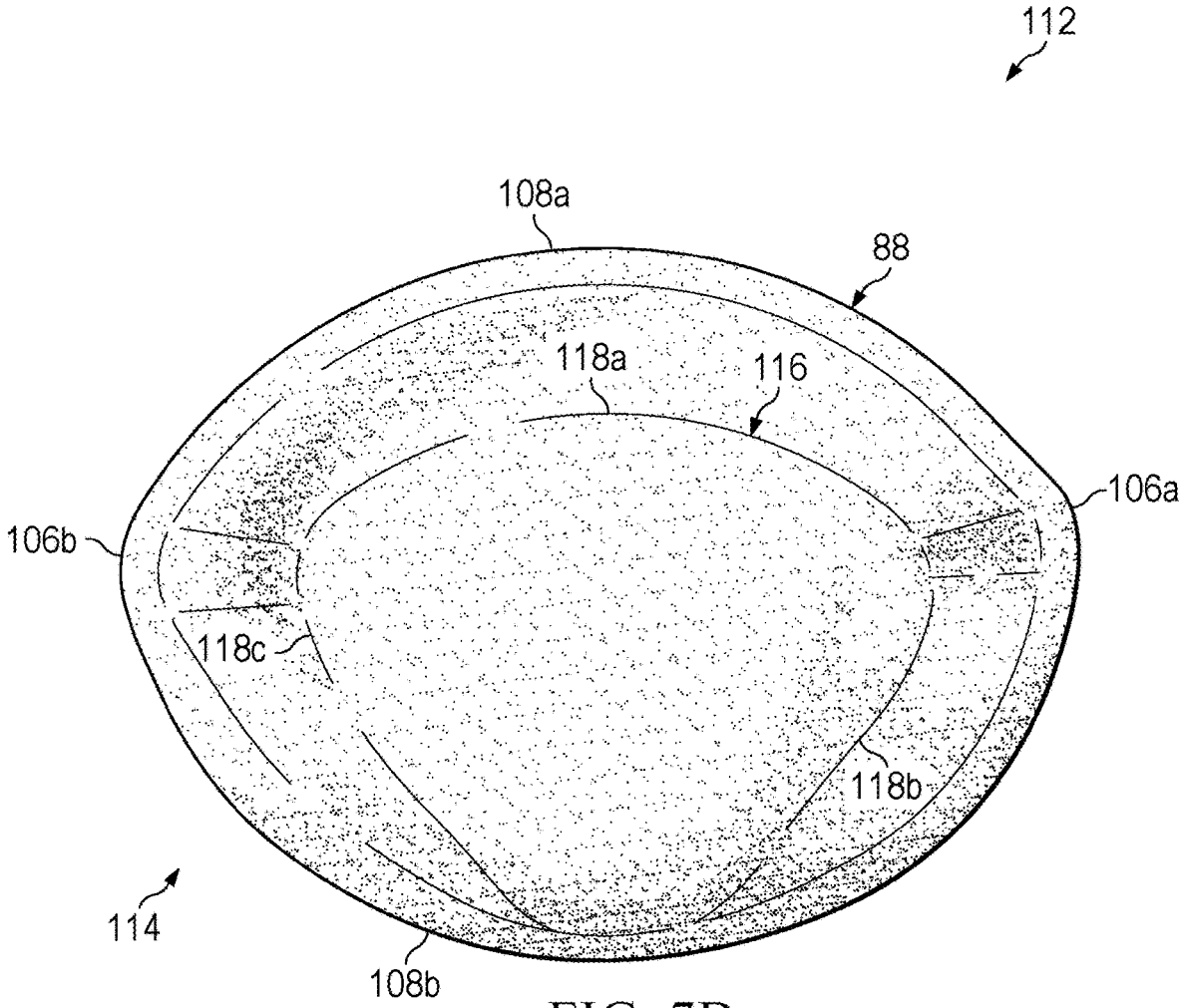
FIG. 7B is a back view of one of the inserts of FIG. 6, according to one or more embodiments.

Referring to FIG. 7B with continuing reference to FIGS. 6-7A, a back view of the non-removable insert 88 of swimsuit 80 for small chested wearers is generally referred to by reference numeral 112 and includes the back side 114. The back side 114 of the non-removable insert 88 when placed in the swimsuit 80 is closer to the wearer 86, than the front side 104 of the non-removable insert 88. The back side 114 of the non-removable insert 88 is placed further from the front panel 90 and closer to the back panel 91. The front side 104 of the non-removable insert 88 is positioned closer to the front panel 90 than the back panel 91. The front side 104 of the non-removable insert 88 and the back side 114 of the non-removable insert 88 are opposing sides. The back side 114 includes the first corner 106*a* and the second corner 106*b*, and the first border 108*a* and the second border 108*b*. The perimeter of the non-removable insert 88 is defined by the first border 108*a*, which extends from the first corner 106*a* to the second corner 106*b*, and the second border 108*b*, which extends from the second corner 106*b* to the first corner 106*a*. The back side 114 includes a raised portion 116. The raised portion 116 is positioned in between the first corner 106*a* and the second corner 106*b*. The raised portion 116 is triangular shaped with rounded corners. The raised portion 116 includes a first side 118*a*, a second side 118*b*, and a third side 118*c*. The first side 118*a* of the raised portion 116 is closer to the first border 108*a* than the second border 108*b*. The first side 118*a* follows a route along the first border 108*a*. The second side 118*b* and the third side 118*c* are equal lengths. The second side 118*b* is positioned at least in part between the first corner 106*a* and the second border 108*b*. The third side 118*c* is positioned at least in part between the second corner 106*b* and the second border 108*b*. The first side 118, the second side 118*b*, and the third side 118*c* define the raised portion 116. The first side 118, the second side 118*b*, and the third side 118*c* are associated with an indentation on each of the first side 118, second side 118*b*, and third side 118*c* and/or a portion of the non-removable insert 88 with less thickness than the area surrounding the first, second, and third sides 118*a*, 118*b*, and 118*c*, respectively. The second side 118*b* and the third side 118*c* is sloped and has varying thicknesses. The portion of the non-removable insert 88 with the greatest thickness is positioned in the raised portion 116 and corresponds to the crest 110 on the front side 104. The nipple of the wearer 86 may be positioned along the raised portion 116 when worn. The non-removable insert 88 is contoured to the breast of the wearer 86 and prevents a gap forming between the swimsuit 80 and the breast of the wearer 86.

Figure 7C:
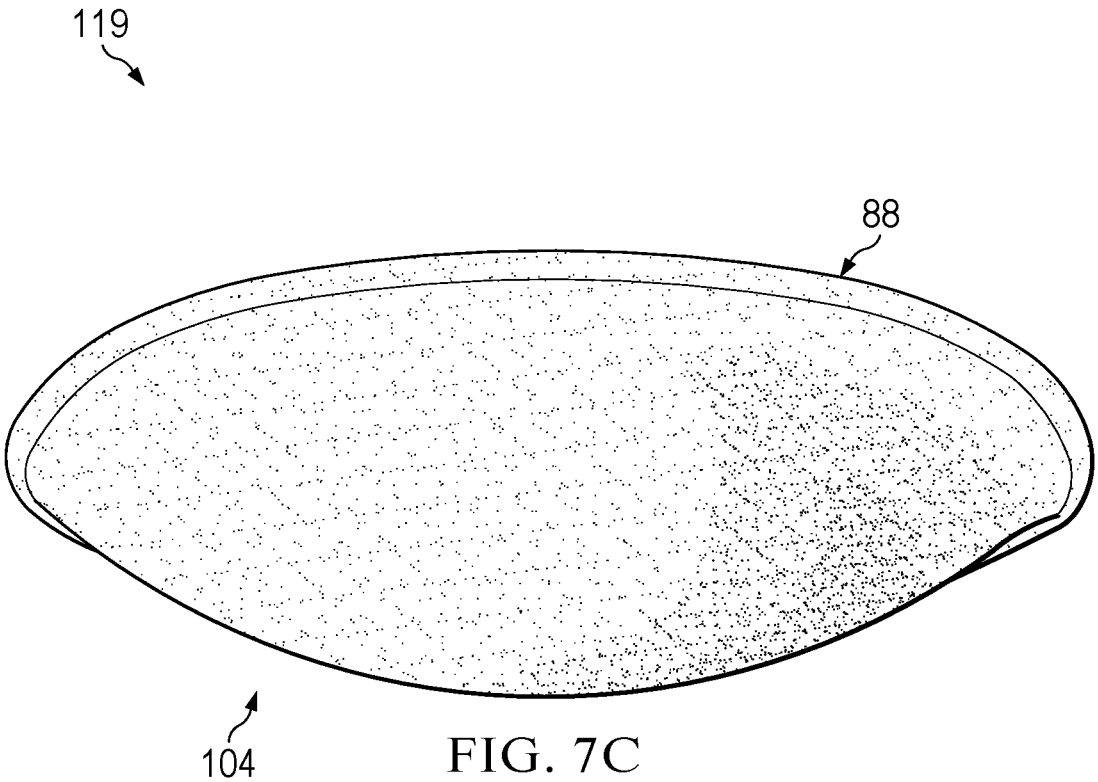
FIG. 7C is a perspective front view of one of the inserts of FIG. 6, according to one or more embodiments.

Referring to FIG. 7C with continuing reference to FIGS. 6-7B, a perspective front view of the non-removable insert 88 of swimsuit 80 for small chested wearers is generally referred to by reference numeral 119 and includes the front side 104.

Figure 7D:
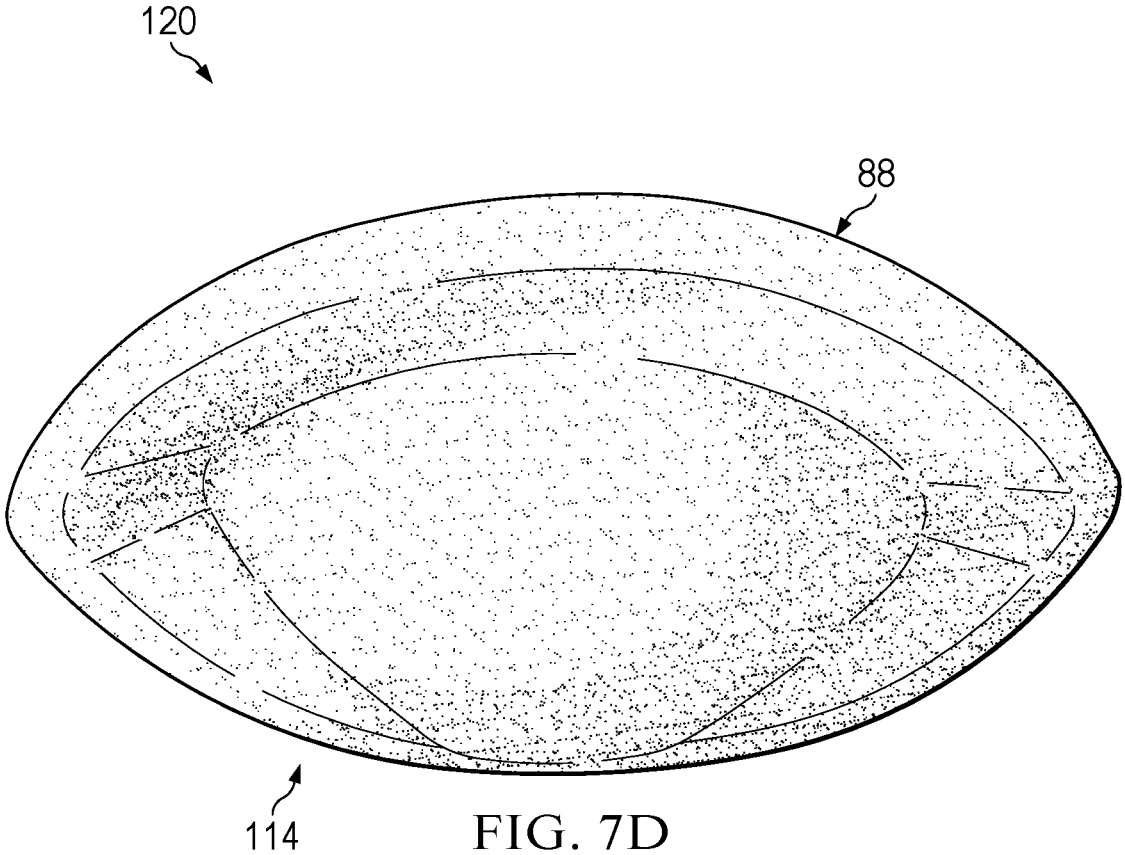
FIG. 7D is a perspective back view of one of the inserts of FIG. 6, according to one or more embodiments.

Referring to FIG. 7D with continuing reference to FIGS. 6-7C, a perspective back view of the non-removable insert 88 of swimsuit 80 for small chested wearers is generally referred to by reference numeral 120 and includes the back side 114.

With continuing reference to FIGS. 6-7D, in some embodiments, the non-removable insert 88 is a silicone-based insert that includes the front side 104 and a back side 114 that opposes the front side 104. The front side 104 of the non-removable insert 88, in some embodiments, is triangular shaped and smooth across the entirety of the front side 104 of the non-removable insert 88 (such as the non-removable insert 18 described above). In some embodiments, the first corner 106*a* and the second corner 106*b* are sharp corners. In other embodiments, the first corner 106*a* and the second corner 106*b* are rounded corners.

The non-removable insert 88 may be sewn into swimsuit 80, as outlined by the stitching in FIG. 6. In some embodiments, the non-removable 88 insert is not sewn in at an angle, but instead the non-removable insert is sewn in straight along a width of the torso.

In some embodiments, the raised portion 116 is shaped as inverted triangle with rounded edges. In one or more embodiments, the raised portion 116 may include a first sub-portion and a second sub-portion. In some embodiments, the first sub-portion and the second sub-portion mirror one another. In other embodiments, the first sub-portion and the second sub-portion differ. In some embodiments, the raised portion 116 may include a dimple or indentation in the middle of a sub-portion connecting the first sub-portion and the second sub-portion. In some embodiments, the dimple may be the indentation 64 described herein.

In one or more embodiments, the nonremovable insert 88 may be clear, nude, or any other color. In some embodiments, the raised portion 116 is integrally formed with the remainder of the non-removable insert 88. In some embodiments, raised portion 116 is crescent shaped, circular shape, or the like. In some embodiments, the raised portion 116 has varying thickness. In some embodiments, a center of the raised portion 116 has the greatest thickness. In other embodiments, the thickness of the raised portion 116 is greatest along the second border 108*b*. In some embodiments, the first side 118*a* of the raised portion has the same thickness level along a length of the first side 118. In some embodiments, the first side 118*a* is the thinnest portion of the non-removable insert 88. In some embodiments, portions along the first border 108*a* and the second border 108*b* have a different thickness than the raised portion 116. In other embodiments, a sub-portion of the raised portion 116 is the same thickness as the portions along the first border 108*a* and the second border 108*b*. In some embodiments, the non-removable insert 88 is made up of a combination of at least one or more of: dimethicone, vinyl silicone oil, anionic polymer, and expandable microsphere. In some embodiments, the non-removable insert 88 is made substantially of silicone. In one or more embodiments, the non-removable insert 88 is composed of dimethicone, vinyl silicone oil, anionic polymer, and expandable microsphere. In other embodiments, the non-removable insert 88 is composed of at least two of: dimethicone, vinyl silicone oil, anionic polymer, and expandable microsphere. In other embodiments, the non-removable insert 88 is made substantially of silicone.

In one or more embodiments, the front panel 90 and the back panel 91 is a contiguous piece of fabric. In some embodiments, the front panel 90 is a different type of material and/or color than a first strip of fabric 96 and/or a second strip of fabric 98. In some embodiments, the front panel 90 is replaced with the front panel 20 described herein. In one or more embodiments, the front panel 90 is shaped like a crescent with two edges and two points. In some embodiments, the front panel 90 is a shape such as an oval, circular, triangular, or the like.

In some embodiments, the back panel 91 is the back panel 34 described herein. In some embodiments, the back panel 91 is a different material and/or color than the front panel 90, the first strip of fabric 96, and/or the second strip of fabric 98. In some embodiments, the back panel 91 is the same size and shape as the front panel 90. In some embodiments, taking a cross-section of the swimsuit 80 along the mid-clavicular line would show the front panel 90, the non-removable insert 88, and the back panel 91 stacked on top of one another, respectively. In one or more embodiments, taking a cross-section of the swimsuit 80 near the anterior axillary line of the wearer 86 would show the front panel 90 stacked on top of the back panel 91, which is due to the non-removable insert 88 being smaller in size than the front panel 90 and the back panel 91.

In one or more embodiments, the one or more straps 92 couple to the front panel 90. In one or more embodiments, the first strip of fabric 96 is at least in part replaced with the one or more straps 92. In one or more embodiments, the one or more straps 92 runs along the first edge 94*a*. In one or more embodiments, the one or more straps 92 are the one or more straps 22 described herein.

In one or more embodiments, the first edge 94*a* and the second edge 94*b* abut one another. In one or more embodiments, a third edge is present that extends between the first edge 94*a* and the second edge 94*b*. In some embodiments, the first edge 94*a* and the second edge 94*b* represent the edges of the front panel that are visible. In other embodiments, the first edge 94*a* is an edge of the first strip of fabric 96 that extends over the front panel 90. In some embodiments, the second edge 94*b* is an edge of the second strip of fabric 98 that extends over the front panel 90. In some embodiments, the first edge 94*a* has a different curvature than the second edge 94*b*.

In one or more embodiments, the first strip of fabric 96 has a varying diameter along the length of the first strip of fabric 96. In one or more embodiments, the second strip of fabric 98 has a varying diameter along the length of the second strip of fabric 98. In other embodiments, the first strip of fabric 96 has a constant diameter along the length of the first strip of fabric 96. In one or more embodiments, the second strip of fabric 98 has a constant diameter along the length of the second strip of fabric 98. In some embodiments, the same stitching that couples the first strip of fabric 96 to the front panel 90 also couples the back panel 92 to the first strip of fabric 96. In some embodiments, the same stitching that couples the second strip of fabric 98 to the front panel 90 also couples the back panel 92 to the second strip of fabric 98. In one or more embodiments, one or more portions of the front panel 90 extends past the first edge 94*a* and the second edge 94*b*. However, the one or more portions are not visible because the one or more portions are sewn under the first strip of fabric 96 and/or the second strip of fabric 98. In some embodiments, the first edge 94*a* and the second edge 94*b* are created by binding, facing, or a similar sewing technique. In some embodiments, instead of using a separate piece of fabric to finish the edges of the front panel 90, the front panel 90 is instead folded and hemmed to create a finished edge. Therefore, in some embodiments, the first strip of fabric 96 and/or the second strip of fabric 98 is not a separate piece of fabric from the front panel 90 but instead a portion of the front panel 90. In some embodiments, a piece of fabric (such as the first strip of fabric 96, the second strip of fabric 98, the band 100, and/or the one or more straps 92) is placed over a first edge 94*a* and/or the second edge 94*b* of the front panel 90 and sewn. A seam allowance is the distance from the seam to an edge of the piece of the fabric. In some embodiments, the first edge 94*a* and/or the second edge 94*b* is the edge of the piece of fabric-because the edge of the piece of fabric marks the beginning of the front panel 90 that is visible. In some embodiments, the one or more straps 92 extend from the band 100 along the first edge 94*a* over a shoulder and back of wearer 86 and reconnects at the band 100 via a coupler. In other embodiments, the one or more straps 92 extend from the first strip of fabric 96 over a shoulder and back of wearer 86 and reconnects at the band 100 via a coupler. The first strip of fabric 96, in some embodiments, is inserted into a portion of the one or more straps 92 and sewn and/or inserted into a portion of the band 100 and sewn. In some embodiments, the second strip of fabric 98 includes an underwire. In some embodiments, the second strip of fabric 98 is a portion of the front panel 90 that is folded and sewn. The second strip of fabric 98 extends along the second edge 94*b*. The second strip of fabric 98, in some embodiments, is sewn to the band 100. In some embodiments, the second strip of fabric 98 extends past the second edge 94*b* along a portion of the first strip of fabric 96. In some embodiments, the second strip of fabric 98 extends past the second edge 94*b* along two opposing portions of the first strip of fabric 96. In one or more embodiments, the second strip of fabric 98 is a portion of the first strip of fabric 96 or a portion of the band 100. In some embodiments, the second strip of fabric 98 is shaped to form a semi-circle.

In one or more embodiments, the band 100 is coupled to at least the one of the one or more straps 92 via stitching. In some embodiments, the band 100 extends at least along a front width of a torso of the wearer 86. The band 100 may be continuous. The band 100, in some embodiments, is non-continuous. In one or more embodiments, the band 100 extends from the second edge 94*b* on the first side 82 to a second edge on the second side 84. In some embodiments, the band 100 include a portion that connects the second edge 94*b* to a second edge on the second side along a front torso of the wearer 86.

In operation, with continuing reference to FIGS. 6-7D, the non-removable insert 88 is disposed between the front panel 90 and a back panel. A first strip of fabric 96 is placed around the first edge 94*a* of the front panel 90. The one or more straps 92 is coupled to the first strip of fabric 96 via stitching. A second strip of fabric 98 is placed around the second edge 94*b* of the front panel 90. Then, the first strip of fabric 96 is sewn along the first edge 94*a* and the second strip of fabric 98 is sewn along the second edge 94*b*. The perimeter of the front panel 90 is stitched along with the back panel 91, which encases the nonremovable insert 88. A band 100 is coupled via stitching to the second strip of fabric 98.

In some embodiments, stitching the perimeter around the front panel 90 and the back panel 91 creates an interior region that permits the nonremovable insert 88 relative movement within the interior region. In some embodiments, the non-removable insert 88 fills the entire width of the front panel 90 and/or the back panel and does not move along the width. In some embodiments, the non-removable insert 88 fills the entire length of the front panel 90 and/or the back panel 91 and does not move along the length. In some embodiments, the stitching around the front panel 90 and the back panel 91 prevents the non-removable insert 88 from being removed. In some embodiments, the non-removable insert 88 may move but only within the interior region created by the front panel 90 and the back panel 91 and may not be taken out of the interior region. In some embodiments, the non-removable insert 88 may be stitched directly to either the front panel 90 and/or the back panel 91. The nonremovable insert 88 may be machine washed. The non-removable insert 88 may be machine washed without being removed from the swimsuit 80. The swimsuit 80 may be suitable for water activities such as swimming and for sun-bathing.

Figure 8:
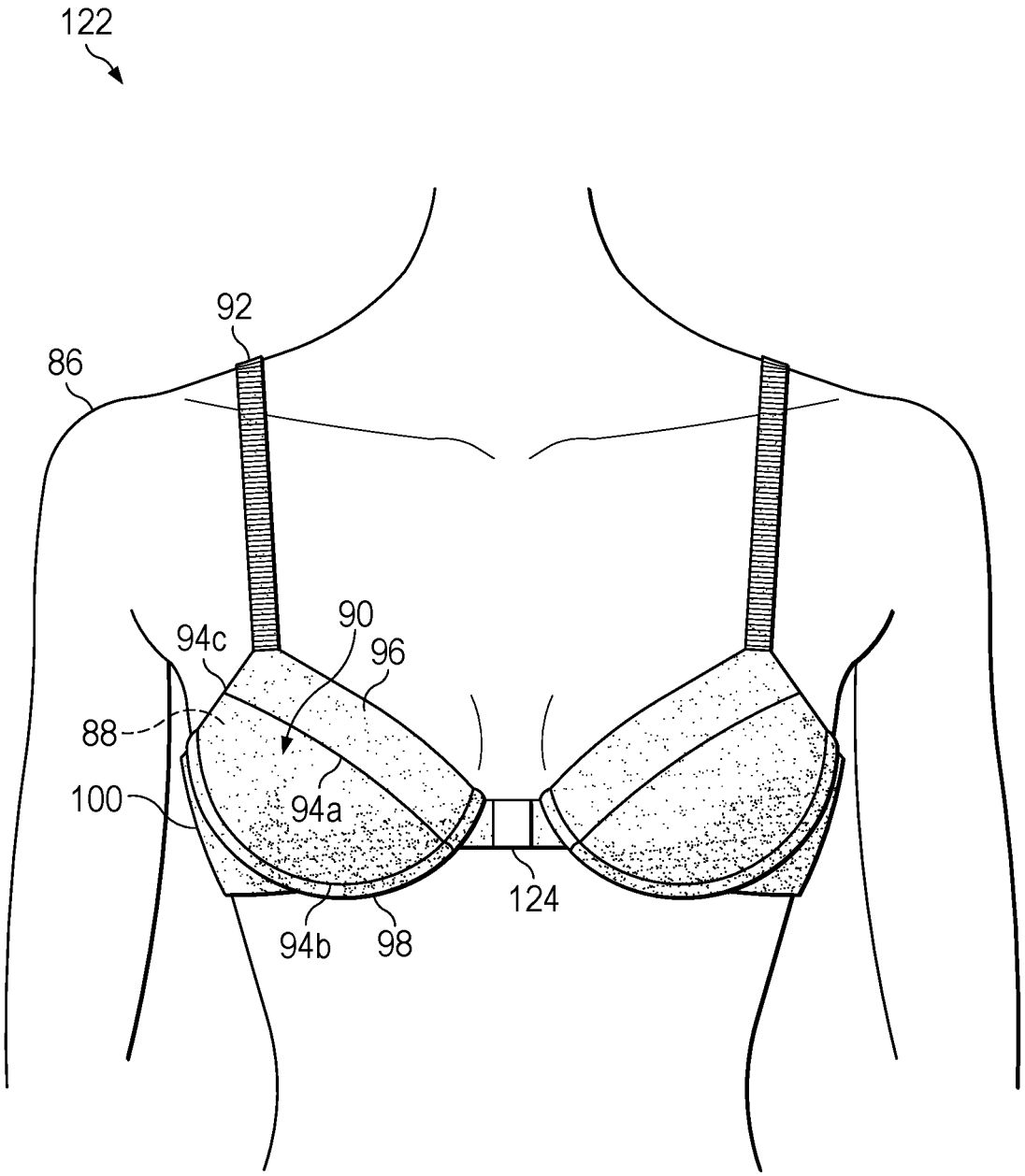
FIG. 8 is another diagrammatic illustration of a swimsuit, according to one or more embodiments.

Referring to FIG. 8, in another embodiment, a swimsuit for small chested wearers is generally referred to by reference numeral 122 and includes several components of the swimsuit 80 of FIGS. 6-7D, which components are given the same reference numerals. The swimsuit 122 includes the non-removable insert 88, the front panel 90, the one or more straps 92, the first strip of fabric 96, the second strip of fabric 98, and the band 100. The front panel 90, in an embodiment, includes a first edge 94*a*, a second edge 94*b*, and a third edge 94*c*. The first strip of fabric 96 extends along the first edge 94*a* and the second strip of fabric 98 extends along the second edge 94*b*. Each edge (the first edge 94*a*, the second edge 94*b*, and the third edge 94*c*) includes stitching surrounding a perimeter of the front panel 90. The stitching encapsulates the nonremovable insert 88. The one or more straps 92 include two straps that are ruched. The band 100 includes a clasp 124.

In some embodiments, the non-removable insert 88 is the one of the other non-removable inserts described herein.

In one or more embodiments, the front panel 90 includes three sides defined by the three edges (the first edge 94*a*, the second edge 94*b*, and the third edge 94*c*, respectively). In one or more embodiments, the front panel 90 includes two sides defined by the two edges (the first edge 94*a* and the second edge 94*b*). In some embodiments, the second edge 94*b* includes an underwire. In one or more embodiments, the second edge 94*b* is shaped as a partial semi-circle. In some embodiments, the first strip of fabric 96 extends along the first edge 94*a* and the third edge 94*c*. In some embodiments, a third strip of fabric extends along the third edge 94*c*. In one or more embodiments, a third strip of fabric is coupled to the third edge 94*c* via stitching. In one or more embodiments, the second strip of fabric 98 is a part of the band 100, the front panel 90, or the first strip of fabric 96. In some embodiments, the first edge 94*a*, the second edge 94*b*, and the third edge 94*c* represent a cut edge of fabric of the front panel 90. In other embodiments, the first edge 94*a*, the second edge 94*b*, and the third edge 94*c* represents an edge of the fabric closest to a seam. For example, the first edge 94*a* may be the edge of the first strip of fabric 96. In one or more embodiments, the first edge 94*a*, the second edge 94*b*, and the third edge 94*c* are created by folding and hemming the front panel 90.

In one or more embodiments, the two straps of the one or more straps 92 is a different fabric from one or more of the first strip of fabric 96, the band 100, and the second strip of fabric 98. In one or more embodiments, the two straps are flat and not ruched, puckered, or the like.

In some embodiments the first strip of fabric 96 and/or the second strip of fabric 98 is the same material, fabric, color, and the like as the front panel 90 and/or the one or more straps 92. In some embodiments, the second strip of fabric 98 is also coupled to the band 100. In some embodiments, the second strip of fabric 98 is a portion of the band 100. In some embodiments, the first strip of fabric 96 ends prior to the band 100 and is not coupled to the band 100. In other embodiments, the first strip of fabric 96 extends along the third edge 94*c* and connects to the band 100. In some embodiments, the first strip of fabric 96 and/or the second strip of fabric 98 is coupled to the front panel 90 and/or the one or more straps 92 using a double-stitched seam. In other embodiments, a single stitched seam is used.

In one or more embodiments, the clasp 124 may be decorative. In some embodiments, the clasp 124 is functional and joins two ends of the band 100 together. The clasp 124, in some embodiments, a slide hook, a hook and eye closure, clicker closure, or the like. In some embodiments, the clasp 124 may be positioned on the opposite end of the band 100 such that it is near the back of the wearer 86.

Figure 9:
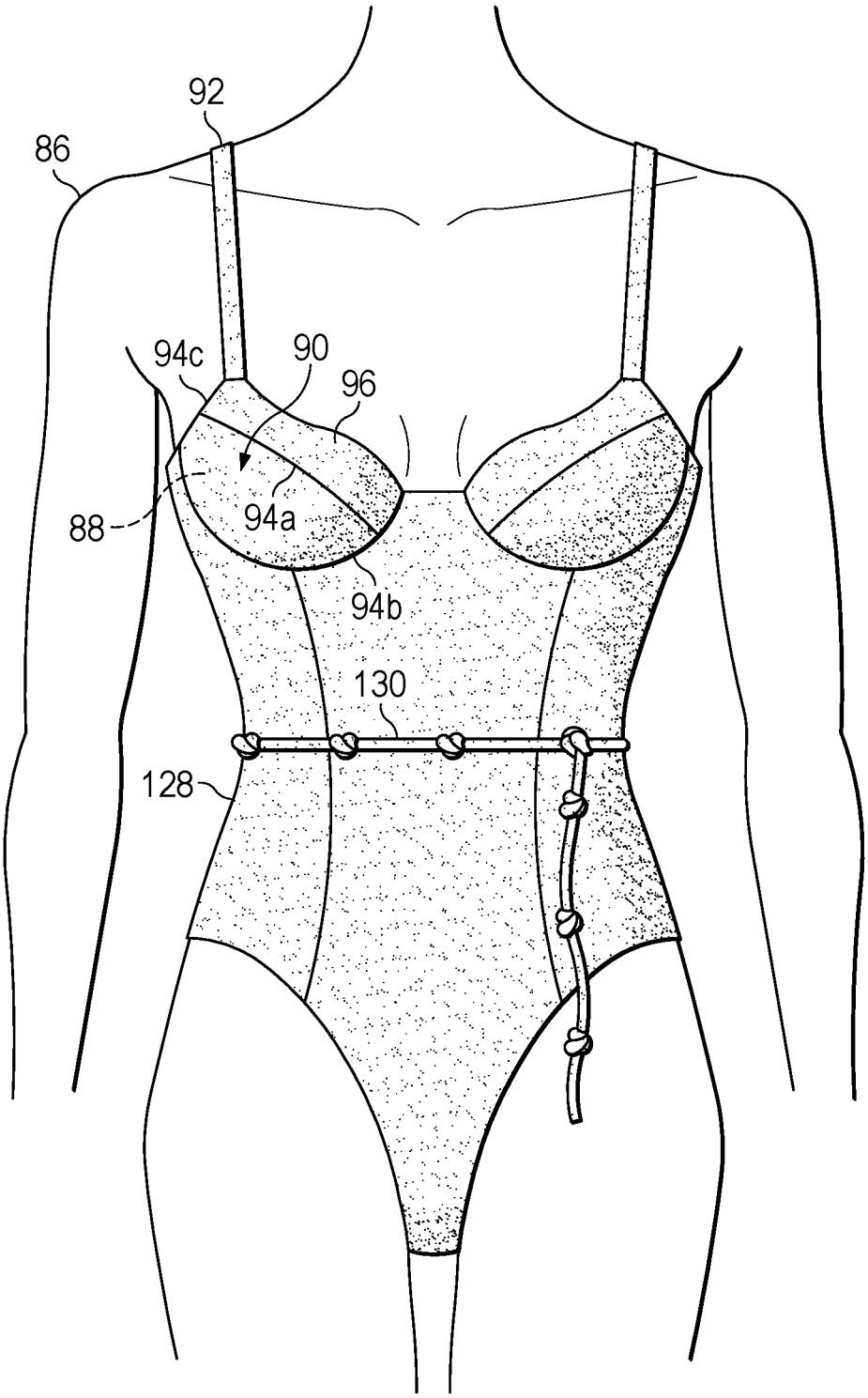
FIG. 9 is yet another diagrammatic illustration of a swimsuit, according to one or more embodiments.

Referring to FIG. 9, in yet another embodiment, a swimsuit for small chested wearers is generally referred to by reference numeral 126 and includes several components of the swimsuit 10 of FIGS. 6-7D and several components of the swimsuit 122 of FIG. 8, which components are given the same reference numerals. The swimsuit 126 includes the non-removable insert 88, the front panel 90, and the one or more straps 92, the first strip of fabric 96. The front panel 90, in an embodiment, includes a first edge 94*a*, a second edge 94*b*, and a third edge 94*c*. The first strip of fabric 96 extends along the first edge 94*a*. Each edge (the first edge 94*a*, the second edge 94*b*, and the third edge 94*c*) includes stitching surrounding a perimeter of the front panel 90. The stitching encapsulates the nonremovable insert 88. The swimsuit 126 includes a bottom portion 128. The bottom portion 128 is coupled to the front panel 90 along the second edge 94*b*. The bottom portion 128 extends from the second edge 94*b* around the bottom of the wearer 86 to the back of the wearer 86 such that the bottom portion forms a one-piece swimsuit. The bottom portion 128 may include a belt 130.

In some embodiments, the non-removable insert 88 is one of the other non-removable inserts described herein.

In some embodiments, the band 100 is coupled to the front panel 90 along the second edge 94*b*. In some embodiments, the band 100 is omitted. In some embodiments the band 100 extends only along a front, width of the torso of the wearer 86. In one or more embodiments, the band does not extend fully around the wearer 86.

In one or more embodiments, the bottom portion 128 includes slits, holes, or the like such that the swimsuit 126 is a monokini. In some embodiments, the bottom portion 128 is made up of a plurality of pieces of fabric sewn together. In some embodiments, the plurality of pieces of fabric are sewn together along a length of the torso of the wearer 86. In some embodiments, the one or more straps 92 attach in the back to the bottom portion 128 rather than to the band 100. In one or more embodiments, the bottom portion 128 includes the belt 130 that wraps fully around the waist of the wearer 86. In some embodiments, the bottom portion 128 includes loops to hold the belt 130 in place.

In operation and with continuing reference to FIGS. 6-9, the swimsuit (swimsuit 80, swimsuit 122, or swimsuit 126) is worn by the wearer 86, who is considered small-chested, generally AA-B cup. The swimsuit (swimsuit 80, swimsuit 122, or swimsuit 126) is made to include two pieces of fabric (e.g., front panel 90 and back panel 91) that fully enclose the non-removable inserts (e.g., non-removable insert 88) on the first and second sides 82 and 84, respectively, of the swimsuit (swimsuit 80, swimsuit 122, or swimsuit 126) via stitching. The non-removable insert 88 is designed to stay in place both in the swimsuit (swimsuit 80, swimsuit 122, or swimsuit 126) and on the wearer 86 wearing the swimsuit (swimsuit 80, swimsuit 122, or swimsuit 126). The non-removable insert 88 contours to a breast of the wearer 86 and provides a gentle lift of the breast.

In some embodiments, the non-removable insert 88 is placed toward the outside of the breast, rather than being centered on the breast of the wearer 86. By placing the non-removable insert 88 to the outside, a different form of lift of the breasts is provided by the swimsuit (swimsuit 80, swimsuit 122, or swimsuit 126), which contours the non-removable insert 88 to the breast. The breasts would be lifted and pushed closer together.

In other embodiments, the non-removable insert 88 is placed such that the second border 108*b* is below the breast and the non-removable insert 18 is centered on the breast in order to provide a gentle lift up, rather than being pushed closer together, which contours the non-removable insert 18 to the breast.

Figure 10A:
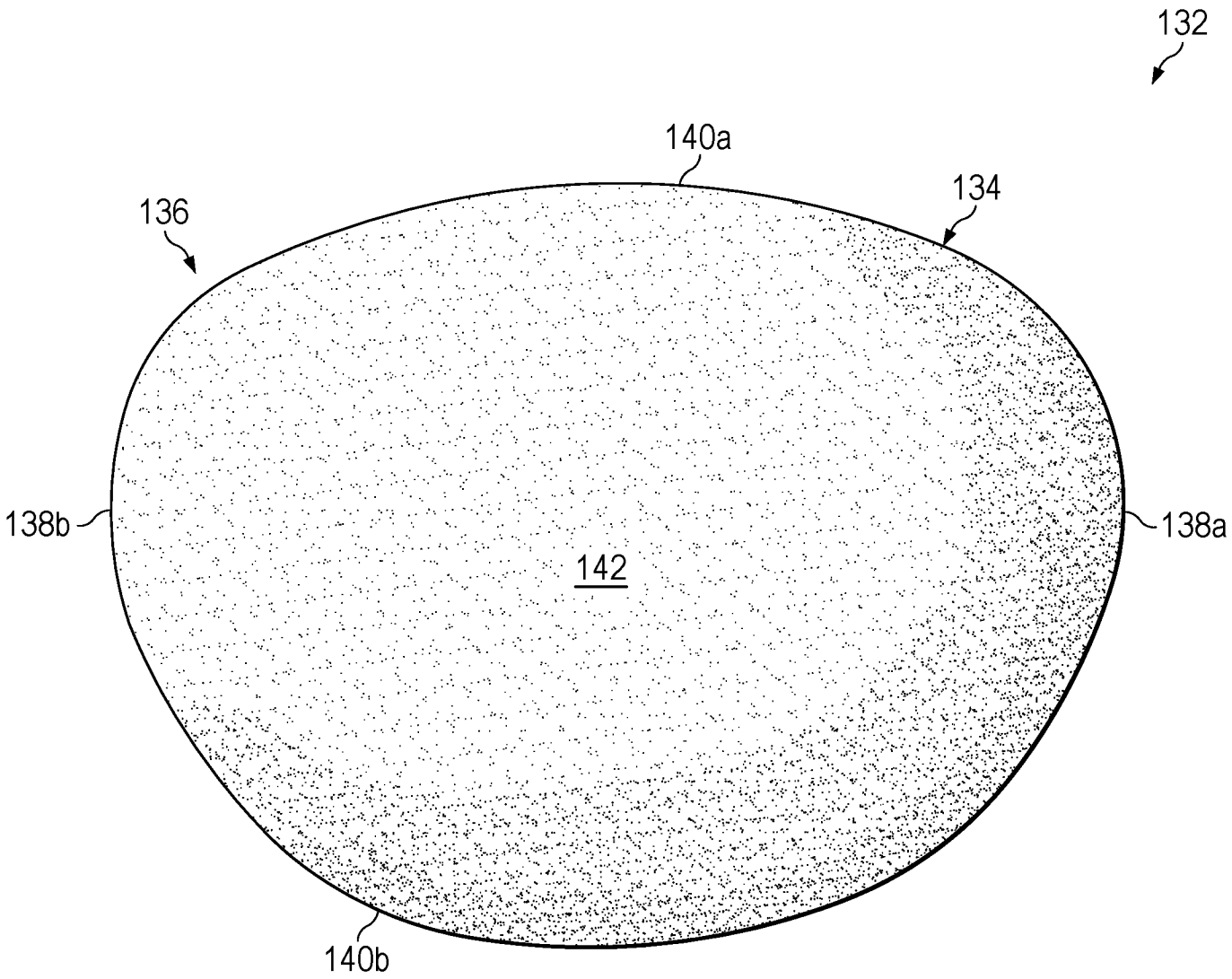
FIG. 10A is a front view of one of a non-removable insert, according to one or more embodiments.

Referring to FIG. 10A, a front view of the non-removable insert 134 for small chested wearers is generally referred to by reference numeral 132 and includes a front side 136. The front side 136 includes a first corner 138*a* and a second corner 138*b*. The second corner 138*b* opposes the first corner 138*a*. The front side 136 of the non-removable insert 134 includes a top edge 140*a* and a bottom edge 140*b*. The perimeter of the non-removable insert 134 is defined by the top edge 140*a*, which extends from the first corner 138*a* to the second corner 138*b* and the bottom edge 140*b*, which extends from the second corner 138*b* to the first corner 138*a*. When worn by a wearer, the top edge 140*a* is placed above the nipple of the breast and the bottom edge 140*b* is placed under the nipple of the breast such that the nipple of the breast is placed in between the top edge 140*a* and the bottom edge 140*b*. When worn on a right breast (proper right), the first corner 138*a* is positioned toward the outside of the breast, and the first corner 138*a* is further from the left breast of the wearer than the second corner 138*b*, which is positioned opposite the first corner 138*a*. When worn on a left breast (proper left), the second corner 138*b* is positioned toward the outside of the breast, and the second corner 138*b* is further from the right breast of the wearer than the first corner 138*a*, which is positioned opposite the second corner 138*b*. The front side 136 includes a crest 142, which represents a peak of the non-removable insert 134. The crest 142 is positioned between the first corner 138*a* and the second corner 138*b* and disposed between the top edge 140*a* and the bottom edge 140*b*. The crest 142 is a portion of the non-removable insert 134 that is raised higher than the remainder of the portions of the non-removable insert 134.

Figure 10B:
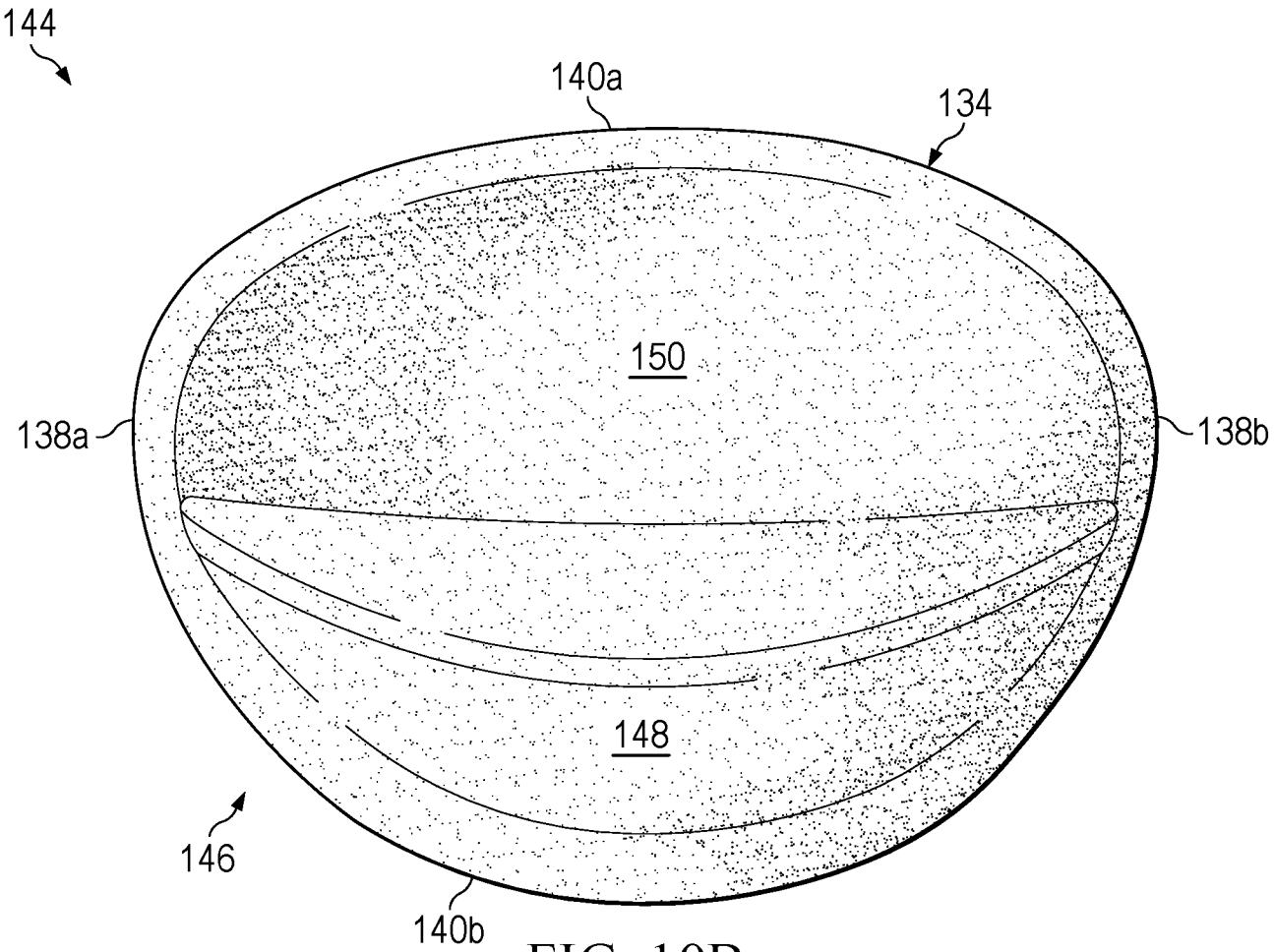
FIG. 10B is a back view of the non-removable insert of FIG. 10A, according to one or more embodiments.

Referring to FIG. 10B with continuing reference to FIG. 10A, a back view of the non-removable insert 134 is generally referred to by reference numeral 144 and includes the back side 146. The front side 136 of the non-removable insert 134 and the back side 146 of the non-removable insert 134 are opposing sides. The back side 146 includes the first corner 138*a* and the second corner 138*b*, and the top edge 140*a* and the bottom edge 140*b*. The perimeter of the non-removable insert 134 is defined by the top edge 140*a*, which extends from the first corner 138*a* to the second corner 138*b*, and the bottom edge 140*b*, which extends from the second corner 138*b* to the first corner 138*a*. The back side 146 includes a raised portion 148 and a lower portion 150. The lower portion 150 is adjacent to the raised portion 148. The raised portion 148 has a greater thickness than the lower portion 150. The raised portion 148 is positioned in between the first corner 138*a* and the second corner 138*b* and is closer to the bottom edge 140*b* than the top edge 140*a*.

The back side 146 of the non-removable insert 134 is placed further from the front panel 90 and closer to a back panel (e.g., the back panel 34 or the back panel 91 described herein). The front side 104 of the non-removable insert 88 is positioned closer to the front panel (e.g., the front panel 20 or the front panel 90) than a back panel (e.g., the back panel 34 or the back panel 91 described herein). The back side 146 of the non-removable insert 134 when placed in a swimsuit (for example, swimsuit 10, swimsuit 70, swimsuit 76, swimsuit 80, swimsuit 122, swimsuit 126) is closest to the wearer such as wearer 16 or wearer 86. The front side 136 of the non-removable insert 134 is further from the wearer 16 or wearer 86 than the back side 146 of the non-removable insert 134.

In some embodiments, a clear film surrounds the non-removable insert 134. In some embodiments, the clear film extends around the top edge 140*a* and the bottom edge 140*b*.

In one or more embodiments, the lower portion 150 is concave and the raised portion 148 is convex. In one or more embodiments, the lower portion 150 does not vary thickness. In some embodiments, the raised portion 148 varies thickness along a length of the raised portion 148. In one or more embodiments, the raised portion 148 includes a portion of the non-removable insert 134 with the greatest amount of thickness. In some embodiments, the lower portion 150 includes a portion of the non-removable insert 134 with the least amount of thickness. In some embodiments, the lower portion 150 surrounds the raised portion 148. In other embodiments, the raised portion extends from the bottom edge 140*b*. In one or more embodiments, the raised portion 148 corresponds to the crest 142. In other embodiments, the crest 142 is positioned higher than the raised portion 148. In some embodiments, the raised portion 148 is the portion of the non-removable insert 134 with the greatest thickness.

In some embodiments, the nipple of the wearer is placed and centered above the raised portion 148, such that a gentle lift up, rather than being pushed closer together, which contours the non-removable insert 134 to the breast. In some embodiments, the raised portion 148 may include a dimple or indentation in the middle of raised portion. In some embodiments, the dimple may be the indentation 64 described herein.

The present disclosure introduces a swimsuit for a small-chested wearer, the swimsuit generally includes: a first portion configured to be positioned over a first breast of the small-chested wearer, the first portion includes: a first front panel; a first non-removable insert, disposed behind the first front panel; a first back panel, disposed behind the front panel and the first non-removable insert, wherein the first back panel is configured to contact skin of the first breast; wherein a perimeter of the first back panel is aligned with a perimeter of the first front panel; wherein the entire perimeter of the first front panel and the entire perimeter of the first back panel are stitched together such that a first interior region is formed; wherein the first non-removable insert is disposed within the first interior region such that: the first non-removable insert is encased by the stitching between the entire perimeter of the first front panel and the entire perimeter of the first back panel; and the first non-removable insert is permanently disposed within the first interior region; and wherein the first non-removable insert comprises silicone; a second portion configured to be positioned over a second breast of the small-chested wearer, the second portion including: a second front panel; a second nonremovable insert, disposed behind the second front panel; a second back panel, disposed behind the second front panel and the second non-removable insert, wherein the second back panel is configured to contact skin of the second breast; wherein a perimeter of the second back panel is aligned with a perimeter of the second front panel; wherein the entire perimeter of the second front panel and the entire perimeter of the second back panel are stitched together such that a second interior region is formed; wherein the second non-removable insert is disposed within the second interior region such that: the second non-removable insert is encased by the stitching between the entire perimeter of the second front panel and the entire perimeter of the second back panel; and the second non-removable insert is permanently disposed within the second interior region; and wherein the second non-removable insert comprises silicone; and a band that couples the first portion to the second portion. In one or more embodiments, the first non-removable insert includes a front side and an opposing back side; the front side includes a continuous and smooth surface; the back side includes a raised portion, the raised portion includes a thickness that is greater than any other thickness of the back side of the first non-removable insert; and the raised portion includes: a first raised sub-portion; a second raised sub-portion; and a third raised sub-portion, the second raised sub-portion is disposed between the first raised sub-portion and the third raised sub-portion; the second raised sub-portion includes an indentation; the indentation is configured to fit at least a portion of a nipple of the first breast of the small-chested wearer; and due to the indentation, the second raised sub-portion defines a diameter that is less than a diameter of the first raised sub-portion or a diameter of the third raised sub-portion. In one or more embodiments, the first non-removable insert includes a front side and an opposing back side; the front side includes a continuous and smooth surface; the back side includes a raised portion and a lower portion; and the raised and lower portions define first and second thicknesses, respectively; the first thickness of the raised portion of the back side of the first non-removable insert is greater than the second thickness of the lower portion of the back side of the first non-removable insert. In one or more embodiments, the first non-removable insert is permitted to move, within the first interior region and relative to the stitching between the entire perimeter of the first front panel and the entire perimeter of the first back panel. In one or more embodiments, the second non-removable insert is permitted to move, within the second interior region and relative to the stitching between the entire perimeter of the second front panel and the entire perimeter of the second back panel. In one or more embodiments, the first portion further includes: a first strip of fabric coupled to the first front panel and the first back panel via a first stitching; and a second strip of fabric coupled to the first front panel and the first back panel via a second stitching; a first edge of the first strip defines a first boundary of the first front panel; a first edge of the second strip defines a second boundary of the first front panel; the first front panel and the first back panel are aligned with one another such that: the first stitching couples a portion of the first front panel to a portion of the first back panel; and the second stitching couples another portion of the first front panel to another portion of the first back panel; the first stitching and the second stitching at least partially define an interior region between the first front panel and the first back panel; and the first non-removable insert is configured to support the first breast when the swimsuit is worn by the small-chested wearer and the first portion is positioned over the first breast. In one or more embodiments, the first portion further includes: a third strip of fabric coupled to the first front panel and the first back panel via a third stitching; a first edge of the third strip defines a third boundary of the first front panel; and the first stitching, second stitching, and third stitching define an entire perimeter of the interior region between the first front panel and the first back panel. In one or more embodiments the first non-removable insert includes a front side and an opposing back side; the front side includes a continuous and smooth surface; the back side includes a raised portion and a lower portion; the raised and lower portions define first and second thicknesses, respectively; and the lower portion surrounds the raised portion. In one or more embodiments, a first boundary extends from a first rounded corner to a second rounded corner; a second boundary extends from the second rounded corner to a third rounded corner; a third boundary extends from the third rounded corner to the first rounded corner; and the first boundary, the second boundary, and the third boundary define a perimeter of the raised portion. In one or more embodiments, a first boundary extends from a first rounded corner to a second rounded corner; a second boundary extends from the second rounded corner to the first rounded corner; and the first boundary and the second boundary define a perimeter of the raised portion.

The present disclosure introduces a swimsuit for a small-chested wearer, the swimsuit generally includes: a first portion configured to be positioned over a first breast of the small-chested wearer, the first portion including: a front panel; an insert, disposed behind the front panel; a back panel, disposed behind the front panel and the insert, wherein the back panel is configured to contact skin of the first breast; a first strip of fabric coupled to the front panel and the back panel via a first stitching; and a second strip of fabric coupled to the front panel and the back panel via a second stitching; wherein a first edge of the first strip defines a first boundary of the front panel; wherein a first edge of the second strip defines a second boundary of the front panel; wherein the front panel and the back panel are aligned with one another such that: the first stitching couples a portion of the front panel to a portion of the back panel; and the second stitching couples another portion of the front panel to another portion of the back panel; wherein the first stitching and the second stitching at least partially define an interior region between the front and the back panels; wherein the insert is disposed within the interior region; wherein the insert includes silicone; and wherein the insert is configured to support the first breast when the swimsuit is worn by the small-chested wearer and the first portion is positioned over the first breast; and a second portion of the swimsuit configured to be positioned over a second breast of the small-chested wearer; and a band that couples the first portion to the second portion. In one or more embodiments, the insert includes a front side and an opposing back side; the front side includes a continuous and smooth surface; the back side includes a raised portion, the raised portion includes a thickness that is greater than any other thickness of the back side of the insert; and the raised portion includes: a first raised sub-portion; a second raised sub-portion; and a third raised sub-portion, the second raised sub-portion is disposed between the first raised sub-portion and the third raised sub-portion; the second raised sub-portion includes an indentation; the indentation is configured to fit at least a portion of a nipple of the first breast of the small-chested wearer; and due to the indentation, the second raised sub-portion defines a diameter that is less than a diameter of the first raised sub-portion or a diameter of the third raised sub-portion. In one or more embodiments, the insert includes a front side and an opposing back side; the front side includes a continuous and smooth surface; the back side includes a raised portion and a lower portion; and the raised and lower portions define first and second thicknesses, respectively; the first thickness of the raised portion of the back side of the insert is greater than the second thickness of the lower portion of the back side of the insert. In one or more embodiments, the first stitching and the second stitching define an entire perimeter of the interior region between the front and back panels; and the insert is encased by the first and the second stitching such that the insert is non-removable. In one or more embodiments, the non-removable insert is permitted to move, within the interior region and relative to the first and second stitching. In one or more embodiments, the first portion further includes: a third strip of fabric coupled to the front panel and the back panel via a third stitching; the first stitching, the second stitching, and the third stitching define an entire perimeter of the interior region between the front and the back panels; the insert is disposed within the interior region such that: the insert is non-removable. In one or more embodiments, the non-removable insert is permitted to move, within the interior region and relative to the first and second stitching. In one or more embodiments, the insert includes a front side and an opposing back side; the front side includes a continuous and smooth surface; the back side includes a raised portion and a lower portion; the raised and lower portions define first and second thicknesses, respectively; and the lower portion surrounds a perimeter of the raised portion. In one or more embodiments, a first boundary extends from a first rounded corner to a second rounded corner; a second boundary extends from the second rounded corner to a third rounded corner; a third boundary extends from the third rounded corner to the first rounded corner; and the first boundary, the second boundary, and the third boundary define a perimeter of the raised portion. In one or more embodiments, a first boundary extends from a first rounded corner to a second rounded corner; a second boundary extends from the second rounded corner to the first rounded corner; and the first boundary and the second boundary define a perimeter of the raised portion.

It is understood that variations may be made in the foregoing without departing from the scope of the disclosure.

In several embodiments, the elements and teachings of the various illustrative embodiments may be combined in whole or in part in some or all of the illustrative embodiments. In addition, one or more of the elements and teachings of the various illustrative embodiments may be omitted, at least in part, or combined, at least in part, with one or more of the other elements and teachings of the various illustrative embodiments.

Any spatial references such as, for example, "upper," "lower," "above," "below," "between," "bottom," "vertical," "horizontal," "angular," "upwards," "downwards," "side-to-side," "left-to-right," "left," "right," "right-to-left," "top-to-bottom," "bottom-to-top," "top," "bottom," "bottom-up," "top-down," etc., are for the purpose of illustration only and do not limit the specific orientation or location of the structure described above.

In several embodiments, while different steps, processes, and procedures are described as appearing as distinct acts, one or more of the steps, one or more of the processes, or one or more of the procedures may also be performed in different orders, simultaneously or sequentially. In several embodiments, the steps, processes, or procedures may be merged into one or more steps, processes, or procedures. In several embodiments, one or more of the operational steps in each embodiment may be omitted. Moreover, in some instances, some features of the present disclosure may be employed without a corresponding use of the other features.

Although several embodiments have been disclosed in detail above, the embodiments disclosed are exemplary only and are not limiting, and those skilled in the art will readily appreciate that many other modifications, changes, and substitutions are possible in the embodiments without materially departing from the novel teachings and advantages of the present disclosure. Accordingly, all such modifications, changes, and substitutions are intended to be included within the scope of this disclosure as defined in the following claims. In the claims, means-plus-function clauses are intended to cover the structures described herein as performing the recited function and not only structural equivalents, but also equivalent structures. Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus for a small-chested wearer, the apparatus comprising:

a first portion configured to be positioned over a first breast of the small-chested wearer, the first portion comprising:

a first front panel;

a first non-removable insert, disposed behind the first front panel;

a first back panel, disposed behind the first front panel and the first non-removable insert, wherein the first back panel is configured to contact skin of the first breast;

wherein a perimeter of the first back panel is aligned with a perimeter of the first front panel;

wherein the perimeter of the first front panel and the perimeter of the first back panel are stitched together such that a first interior region is formed; and wherein the first non-removable insert is disposed within the first interior region such that:

the first non-removable insert is encased by the stitching between the perimeter of the first front panel and the perimeter of the first back panel; and the first non-removable insert is permanently disposed within the first interior region;

a second portion configured to be positioned over a second breast of the small-chested wearer, the second portion comprising:

a second front panel;

a second non-removable insert, disposed behind the second front panel;

a second back panel, disposed behind the second front panel and the second non-removable insert, wherein the second back panel is configured to contact skin of the second breast;

wherein a perimeter of the second back panel is aligned with a perimeter of the second front panel;

wherein the perimeter of the second front panel and the perimeter of the second back panel are stitched together such that a second interior region is formed; and wherein the second non-removable insert is disposed within the second interior region such that:

the second non-removable insert is encased by the stitching between the perimeter of the second front panel and the perimeter of the second back panel; and the second non-removable insert is permanently disposed within the second interior region;

and a band that couples the first portion to the second portion;

wherein the first portion further comprises:

a first strip of material coupled to the first front panel and the first back panel via a first stitching, which is part of the stitching between the perimeter of the first front panel and the perimeter of the first back panel; and a second strip of material coupled to the first front panel and the first back panel via a second stitching, which is part of the stitching between the perimeter of the first front panel and the perimeter of the first back panel;

wherein a first edge of the first strip defines a first boundary of the first front panel;

wherein a first edge of the second strip defines a second boundary of the first front panel;

wherein the first front panel and the first back panel are aligned with one another such that:

the first stitching couples a portion of the first front panel to a portion of the first back panel; and the second stitching couples another portion of the first front panel to another portion of the first back panel; and wherein the first portion further comprises:

a third strip of material coupled to the first front panel and the first back panel via a third stitching, which is part of the stitching between the perimeter of the first front panel and the perimeter of the first back panel;

wherein a first edge of the third strip defines a third boundary of the first front panel; and wherein the first stitching, second stitching, and third stitching define a perimeter of the first interior region between the first front panel and the first back panel.

2. The apparatus of claim 1, wherein the first non-removable insert comprises a front side and an opposing back side;

wherein the front side comprises a continuous and smooth surface;

wherein the back side comprises a raised portion, wherein the raised portion comprises a thickness that is greater than any other thickness of the back side of the first non-removable insert; and wherein the raised portion comprises:

a first raised sub-portion;

a second raised sub-portion; and a third raised sub-portion, wherein the second raised sub-portion is disposed between the first raised sub-portion and the third raised sub-portion;

wherein the second raised sub-portion comprises an indentation;

wherein the indentation is configured to fit at least a portion of a nipple of the first breast of the small-chested wearer;

and wherein, due to the indentation, the second raised sub-portion defines a diameter that is less than a diameter of the first raised sub-portion or a diameter of the third raised sub-portion.

3. The apparatus of claim 1, wherein the first non-removable insert comprises a front side and an opposing back side;

wherein the front side comprises a continuous and smooth surface;

wherein the back side comprises a raised portion and a lower portion;

wherein the raised and lower portions define first and second thicknesses, respectively; and wherein the first thickness of the raised portion of the back side of the first non-removable insert is greater than the second thickness of the lower portion of the back side of the first non-removable insert.

4. The apparatus of claim 1, wherein the first non-removable insert is permitted to move, within the first interior region and relative to the stitching between the perimeter of the first front panel and the perimeter of the first back panel.

5. The apparatus of claim 4, wherein the second non-removable insert is permitted to move, within the second interior region and relative to the stitching between the perimeter of the second front panel and the entire-perimeter of the second back panel.

6. The apparatus of claim 1, wherein the first non-removable insert comprises a front side and an opposing back side;

wherein the front side comprises a continuous and smooth surface;

wherein the back side comprises a raised portion and a lower portion surrounding the raised portion; and wherein the raised and lower portions define first and second thicknesses, respectively, the first thickness being greater than the second thickness.

7. The apparatus of claim 6, wherein the raised portion comprises first, second, and third rounded corners, and has a perimeter defined by first, second, and third boundaries;

wherein the first boundary extends from the first rounded corner to the second rounded corner;

wherein the second boundary extends from the second rounded corner to the third rounded corner; and wherein the third boundary extends from the third rounded corner to the first rounded corner.

8. The apparatus of claim 6, wherein the raised portion comprises first and second rounded corners, and has a perimeter defined by first and second boundaries;

wherein the first boundary extends from the first rounded corner to the second rounded corner; and wherein the second boundary extends from the second rounded corner to the first rounded corner.

9. An apparatus for a small-chested wearer, the apparatus comprising: a first portion configured to be positioned over a first breast of the small-chested wearer, the first portion comprising:

a front panel;

an insert, disposed behind the front panel;

a back panel, disposed behind the front panel and the insert, wherein the back panel is configured to contact skin of the first breast;

a first strip of material coupled to the front panel and the back panel via a first stitching; and a second strip of material coupled to the front panel and the back panel via a second stitching;

wherein a first edge of the first strip defines a first boundary of the front panel;

wherein a first edge of the second strip defines a second boundary of the front panel;

wherein the front panel and the back panel are aligned with one another such that:

the first stitching couples a portion of the front panel to a portion of the back panel; and the second stitching couples another portion of the front panel to another portion of the back panel;

wherein the first stitching and the second stitching at least partially define an interior region between the front and the back panels;

wherein the insert is disposed within the interior region; and wherein the apparatus further comprises:

a second portion of the apparatus configured to be positioned over a second breast of the small-chested wearer; and a band that couples the first portion to the second portion; and wherein the first portion further comprises:

a third strip of material coupled to the front panel and the back panel via a third stitching;

wherein the first stitching, the second stitching, and the third stitching define a perimeter of the interior region between the front and the back panels; and wherein the insert is disposed within the interior region, and encased by the first stitching, the second stitching, and the third stitching, such that the insert is non-removable from the interior region.

10. The apparatus of claim 9, wherein the insert comprises a front side and an opposing back side;

wherein the front side comprises a continuous and smooth surface;

wherein the back side comprises a raised portion, wherein the raised portion comprises a thickness that is greater than any other thickness of the back side of the insert; and wherein the raised portion comprises:

a first raised sub-portion;

a second raised sub-portion; and a third raised sub-portion;

wherein the second raised sub-portion is disposed between the first raised sub-portion and the third raised sub-portion;

wherein the second raised sub-portion comprises an indentation;

wherein the indentation is configured to fit at least a portion of a nipple of the first breast of the small-chested wearer;

and wherein, due to the indentation, the second raised sub-portion defines a diameter that is less than a diameter of the first raised sub-portion or a diameter of the third raised sub-portion.

11. The apparatus of claim 9, wherein the insert comprises a front side and an opposing back side;

wherein the front side comprises a continuous and smooth surface;

wherein the back side comprises a raised portion and a lower portion;

wherein the raised and lower portions define first and second thicknesses, respectively; and wherein the first thickness of the raised portion of the back side of the insert is greater than the second thickness of the lower portion of the back side of the insert.

12. The apparatus of claim 9, wherein the non-removable insert is permitted to move, within the interior region and relative to the first stitching and the second stitching.

13. The apparatus of claim 9, wherein the insert comprises a front side and an opposing back side;

wherein the front side comprises a continuous and smooth surface;

wherein the back side comprises a raised portion and a lower portion surrounding the raised portion; and wherein the raised and lower portions define first and second thicknesses, respectively, the first thickness being greater than the second thickness.

14. The apparatus of claim 13, wherein the raised portion comprises first, second, and third rounded corners, and has a perimeter defined by first, second, and third boundaries;

wherein the first boundary extends from the first rounded corner to the second rounded corner;

wherein the second boundary extends from the second rounded corner to the third rounded corner; and wherein the third boundary extends from the third rounded corner to the first rounded corner.

15. The apparatus of claim 13, wherein the raised portion comprises first and second rounded corners, and has a perimeter defined by first and second boundaries;

wherein the first boundary extends from the first rounded corner to the second rounded corner; and wherein the second boundary extends from the second rounded corner to the first rounded corner.

16. The apparatus of claim 1, wherein the apparatus is a swimsuit.

17. The apparatus of claim 1, wherein the first non-removable insert comprises silicone; and wherein the second non-removable insert comprises silicone.

18. The apparatus of claim 1, wherein the first strip of material is a first strip of fabric;

wherein the second strip of material is a second strip of fabric;

wherein the third strip of material is a third strip of fabric;

wherein the first and second strips of material are first and second strips of fabric, respectively;

wherein the second and third strips of material are second and third strips of fabric, respectively;

wherein the first and third strips of material are first and third strips of fabric, respectively; or wherein the first, second, and third strips of material are first, second, and third strips of fabric, respectively.

19. The apparatus of claim 9, wherein the apparatus is a swimsuit.

20. The apparatus of claim 9, wherein the non-removable insert comprises silicone.

21. The apparatus of claim 9, wherein the first strip of material is a first strip of fabric;

wherein the second strip of material is a second strip of fabric;

wherein the third strip of material is a third strip of fabric;

wherein the first and second strips of material are first and second strips of fabric, respectively;

wherein the second and third strips of material are second and third strips of fabric, respectively;

wherein the first and third strips of material are first and third strips of fabric, respectively; or wherein the first, second, and third strips of material are first, second, and third strips of fabric, respectively.

* * * * *